US012516588B2

(12) United States Patent
Upchurch

(10) Patent No.: US 12,516,588 B2
(45) Date of Patent: Jan. 6, 2026

(54) AUTONOMOUS SELF-REGULATING INJECTION CONTROL VALVE (ASRICV)

(71) Applicant: Chevron U.S.A. Inc., San Ramon, CA (US)

(72) Inventor: Eric Roberto Upchurch, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 15 days.

(21) Appl. No.: 18/530,416

(22) Filed: Dec. 6, 2023

(65) Prior Publication Data

US 2024/0191599 A1 Jun. 13, 2024

Related U.S. Application Data

(60) Provisional application No. 63/386,410, filed on Dec. 7, 2022.

(51) Int. Cl.
*E21B 34/10* (2006.01)
*E21B 43/26* (2006.01)

(52) U.S. Cl.
CPC ..... *E21B 34/10* (2013.01); *E21B 43/26* (2013.01); *E21B 2200/02* (2020.05); *E21B 2200/06* (2020.05)

(58) Field of Classification Search
CPC ..... E21B 34/10; E21B 34/14; E21B 43/123; E21B 43/26; E21B 2200/02; E21B 2200/06
See application file for complete search history.

(56) References Cited

U.S. PATENT DOCUMENTS 2,999,546 A * 9/1961 Grimmer ..... E21B 34/14 137/155
3,101,735 A * 8/1963 Brown ..... E21B 43/123 137/155
3,130,784 A * 4/1964 Pennington, II .. E21B 43/11852 166/305.1

(Continued)

FOREIGN PATENT DOCUMENTS

CA 2752521 A1 * 9/2010 ..... E21B 21/103
CA 2868880 C * 9/2016 ..... E21B 34/14

(Continued)

*Primary Examiner* — Jennifer H Gay
(74) *Attorney, Agent, or Firm* — Smith & Woldesenbet Law Group, PLLC

(57) ABSTRACT

A sub used for subterranean injections can include a housing having a housing wall forming a cavity, where the housing is configured to be placed inline with a tubing string, and where the housing wall has a first flow orifice that traverses therethrough. The sub can also include an autonomous self-regulating injection control valve (ASRICV) disposed within the cavity, where the ASRICV can include: a chamber having a second flow orifice that traverses therethrough, where the first flow orifice and the second flow orifice are aligned with each other; a sleeve movably disposed within the chamber, wherein the sleeve partially covers the first flow orifice and the second flow orifice when in a closed position; and an actuator disposed within the chamber, where the actuator is configured to move the sleeve, and where the actuator is configured to operate automatically based on conditions in the wellbore.

19 Claims, 18 Drawing Sheets

(56) References Cited

U.S. PATENT DOCUMENTS 4,059,157 A * 11/1977 Crowe ..... E21B 34/063 137/68.22
4,066,128 A * 1/1978 Davis ..... E21B 34/14 166/373
4,429,708 A 2/1984 Streuh
4,429,747 A * 2/1984 Williamson, Jr. ..... E21B 34/14 166/321
4,462,465 A * 7/1984 Strickland ..... E21B 23/03 166/117.5
4,524,831 A * 6/1985 Pringle ..... E21B 23/03 166/322
4,691,778 A * 9/1987 Pyne ..... E21B 34/10 137/538
4,869,100 A 9/1989 Birdwell
5,355,959 A * 10/1994 Walter ..... E21B 34/08 166/321
6,286,594 B1 * 9/2001 French ..... E21B 34/063 166/334.4
8,540,019 B2 * 9/2013 Hofman ..... E21B 43/26 166/308.1
9,016,376 B2 * 4/2015 Surjaatmadja ..... E21B 43/14 166/305.1
9,228,402 B2 * 1/2016 Strilchuk ..... E21B 21/103
9,664,015 B2 * 5/2017 Hofman ..... E21B 43/26
9,856,715 B2 * 1/2018 Themig ..... E21B 21/103
10,018,022 B2 * 7/2018 Mailand ..... E21B 34/14
10,443,345 B2 * 10/2019 Antonsen ..... E21B 34/10
10,590,737 B2 * 3/2020 Churchill ..... E21B 21/103
10,597,974 B2 * 3/2020 Atkins ..... E21B 21/103
10,605,046 B2 3/2020 Ismail et al.
10,648,327 B2 5/2020 Tinnen et al.
11,434,722 B2 9/2022 Green et al.
2009/0025416 A1 1/2009 Murakami et al.
2010/0122819 A1 * 5/2010 Wildman ..... E21B 23/0415 166/117.6
2010/0224371 A1 * 9/2010 Swan ..... E21B 34/10 166/373
2012/0097397 A1 * 4/2012 Hofman ..... E21B 34/142 166/308.1
2014/0034319 A1 * 2/2014 Surjaatmadja ..... E21B 43/26 166/305.1
2014/0246207 A1 * 9/2014 Hofman ..... E21B 43/12 166/373
2014/0251636 A1 * 9/2014 Hofman ..... E21B 34/103 166/373
2015/0041148 A1 * 2/2015 Greenan ..... E21B 34/103 166/374
2015/0096807 A1 * 4/2015 Strilchuk ..... E21B 21/103 175/57
2015/0114499 A1 4/2015 Dohi et al.
2015/0159466 A1 * 6/2015 Themig ..... E21B 34/10 166/222
2015/0233210 A1 * 8/2015 Beck ..... E21B 34/102 166/373
2015/0337624 A1 * 11/2015 Themig ..... E21B 34/063 166/317
2016/0305228 A1 * 10/2016 Mailand ..... E21B 43/255
2017/0254177 A1 * 9/2017 Woodford ..... E21B 34/08
2018/0163509 A1 * 6/2018 Churchill ..... E21B 34/06
2018/0223626 A1 * 8/2018 Wakefield ..... E21B 34/063
2018/0313188 A1 * 11/2018 Antonsen ..... E21B 34/10
2019/0003283 A1 * 1/2019 Atkins ..... E21B 34/10
2024/0191599 A1 * 6/2024 Upchurch ..... E21B 34/066

FOREIGN PATENT DOCUMENTS

CN 103477028 A * 12/2013 ..... E21B 21/103
GB 2147638 A * 5/1985 ..... E21B 23/03
WO WO-2024215338 A1 * 10/2024

* cited by examiner

AUTONOMOUS SELF-REGULATING INJECTION CONTROL VALVE (ASRICV)

CROSS-REFERENCE TO RELATED APPLICATIONS

This application claims priority under 35 U.S.C. § 119 to U.S. Provisional Patent Application Ser. No. 63/386,410, titled "Autonomous Self-Regulating Fluid Injection Control Valve (ASRICV)" and filed on Dec. 7, 2022, the entire contents of which are hereby incorporated herein by reference.

TECHNICAL FIELD

The present disclosure relates to a control valve that allows for a more even distribution of injected fluids along a wellbore penetrating subterranean formations or fractures of different permeabilities or conductivities, respectively.

BACKGROUND

When injecting fluid into subterranean formations or fractures, it is normally desired that the injected fluid enter all the exposed formations or fractures in an evenly distributed fashion. This outcome ensures that no one formation or fracture becomes over-pressured or over-swept. The benefits of this outcome are similarly desired for enhanced oil recovery (EOR), enhanced geothermal systems (EGS), and carbon capture and underground storage (CCUS) applications. In each of these applications the over-flooding of any one formation or fracture reduces either the amount of oil recovered, the amount of heat extracted, or the amount of $CO_2$ stored, respectively. It is, however, typically challenging to obtain an evenly distributed fluid injection profile along a wellbore that spans multiple formations of materially different permeabilities or multiple fractures of materially different conductivities. Attempts at such injection systems may result in only a few zones accepting the bulk of fluid being injected. The proposed invention is intended to overcome this natural tendency and more evenly distribute injected fluids amongst all permeable formations or conductive fractures penetrated by a single wellbore.

SUMMARY

In general, in one aspect, the disclosure relates to a sub used for subterranean injections. The sub may include a housing having a housing wall forming a cavity, where the housing is configured to be placed inline with a tubing string, and where the housing wall has a first flow orifice that traverses therethrough. The sub may also include an autonomous self-regulating injection control valve (ASRICV) disposed within the cavity. The ASRICV of the sub may include a chamber disposed within the cavity, where the chamber is bounded by a chamber wall, where the chamber wall has a second flow orifice that traverses therethrough, and where the first flow orifice and the second flow orifice are aligned with each other. The ASRICV of the sub may also include a sleeve movably disposed within the chamber, where the sleeve has an open position and a plurality of closed positions, and where the sleeve partially covers the first flow orifice and the second flow orifice when in one of the plurality of closed positions. The ASRICV of the sub may further include an actuator disposed within the chamber and in communication with the sleeve, where the actuator is configured to move the sleeve between the open position and the plurality of closed positions, and where the actuator is configured to operate automatically based on conditions in the wellbore.

In another aspect, the disclosure relates to a tubing string used for injecting fluid into a subterranean formation. The tubing string may include a plurality of tubing pipes coupled end to end. The tubing string may also include a sub positioned between a first tubing pipe and a second tubing pipe of the plurality of tubing pipes. The sub of the tubing string may include a housing having a housing wall forming a cavity, where the housing comprises a first coupling feature disposed at a first end and a second coupling feature disposed at a second end, where the first coupling feature is configured to be coupled to the first tubing pipe, where the second coupling feature is configured to be coupled to the second tubing pipe, and where the housing wall has a first flow orifice that traverses therethrough. The sub of the tubing string may also include an autonomous self-regulating injection control valve (ASRICV) disposed within the cavity. The ASRICV of the sub of the tubing string may include a chamber disposed within the cavity, where the chamber is bounded by a chamber wall, where the chamber wall has a second flow orifice that traverses therethrough, and where the first flow orifice and the second flow orifice are aligned with each other. The ASRICV of the sub of the tubing string may also include a sleeve movably disposed within the chamber, where the sleeve has an open position and a plurality of closed positions, and where the sleeve partially covers the first flow orifice and the second flow orifice when in one of the plurality of closed positions. The ASRICV of the sub of the tubing string may further include an actuator disposed within the chamber and in communication with the sleeve, where the actuator is configured to move the sleeve between the open position and the plurality of closed positions, and where the actuator is configured to operate automatically based on conditions in the wellbore.

In yet another aspect, the disclosure relates to a system for injecting fluid into a subterranean formation. The system may include a fluid injection apparatus located at a surface, where the fluid injection apparatus is configured to deliver an injection fluid. The system may also include a tubing string inserted into a wellbore from the surface, wherein the tubing string comprises a plurality of tubing pipes, wherein the injection fluid is delivered by the fluid injection apparatus through a tubing cavity of the tubing string. The system may further include a sub positioned between two of the plurality of tubing pipes. The sub of the system may include a housing having a housing wall forming a cavity, where the housing comprises coupling features that are coupled to the two of the plurality of tubing pipes, and where the housing wall has a first flow orifice that traverses therethrough. The sub of the system may also include an autonomous self-regulating injection control valve (ASRICV) disposed within the cavity. The ASRICV of the sub of the system may include a chamber disposed within the cavity, where the chamber is bounded by a chamber wall, where the chamber wall has a second flow orifice that traverses therethrough, and where the first flow orifice and the second flow orifice are aligned with each other. The ASRICV of the sub of the system may also include a sleeve movably disposed within the chamber, where the sleeve has an open position and a plurality of closed positions, and where the sleeve partially covers the first flow orifice and the second flow orifice when in one of the plurality of closed positions. The ASRICV of the sub of the system may further include an actuator disposed within the chamber and in communication with the sleeve, where the actuator is configured to move the sleeve between the open position and the plurality of closed positions, and where the actuator is configured to operate automatically based on conditions in the wellbore.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
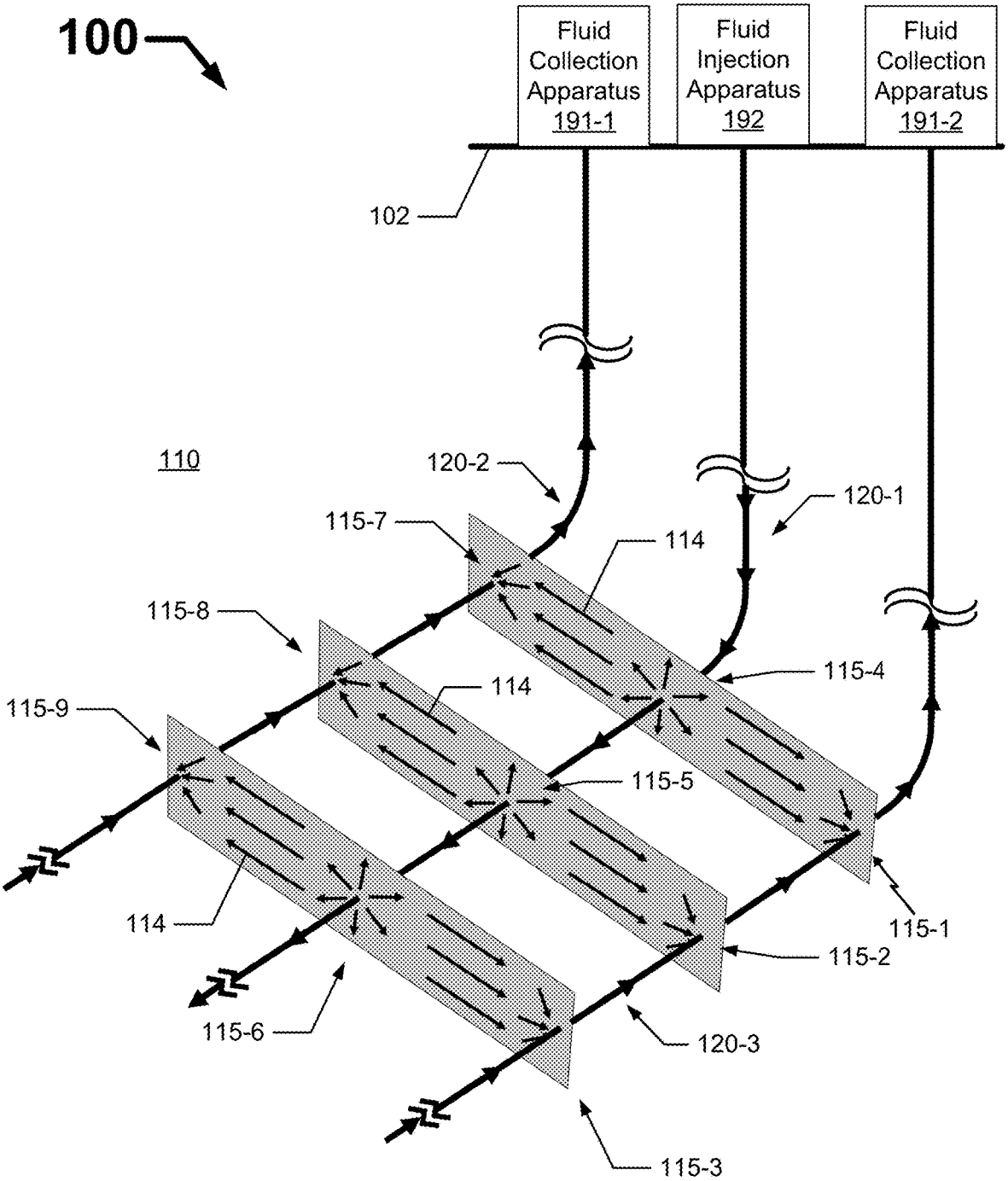
FIGS. 1 and 2 show field systems with which example embodiments can be used.

The example embodiments discussed herein are directed to systems, apparatus, methods, and devices for ASRICVs. Example ASRICVs can be used in any of a number of industries, including but not limited to oil and gas, geothermal, carbon sequestration, and saltwater disposal. Example ASRICVs may be designed to comply with certain standards and/or requirements. Example ASRICVs may be used in any of a number of different environments, including but not limited to subterranean environments (e.g., high temperature, high pressure). In some cases, such environments may be hazardous environments.

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of ±10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

A user may be any person that interacts with control valves, regardless of the environment in which the control valve is located and/or the industry in which the control valve is used. Examples of a user may include, but are not limited to, an engineer, an electrician, an instrumentation and controls technician, a mechanic, an operator, an employee, a consultant, a contractor, and a manufacturer's representative.

Example ASRICVs (including portions thereof) can be made of one or more of a number of suitable materials to allow the associated system or subsystem to meet certain standards and/or regulations while also maintaining durability in light of the one or more conditions under which the ASRICVs and/or other associated components of the ASRICVs can be exposed. Examples of such materials can include, but are not limited to, aluminum, stainless steel, fiberglass, glass, plastic, thermoplastic, ceramic, and rubber.

When used in certain systems (e.g., for certain subsea field operations), example ASRICVs can be designed to comply with certain standards and/or requirements. Examples of entities that set such standards and/or requirements can include, but are not limited to, the Society of Petroleum Engineers, the American Petroleum Institute (API), the International Standards Organization (ISO), the International Association of Classification Societies (IACS), and the Occupational Safety and Health Administration (OSHA).

Example ASRICVs, or portions or components thereof, described herein can be made from a single piece (e.g., as from a mold, injection mold, casting, die cast, forging, extrusion process, or 3D printing). In addition, or in the alternative, example ASRICVs (including portions or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removably, slidably, and threadably.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example ASRICV to become coupled, directly or indirectly, to one or more other components of the ASRICV and/or to some other component of a system or subsystem. A coupling feature can include, but is not limited to, a clamp, a portion of a hinge, an aperture, a recessed area, a protrusion, a hole, a slot, a tab, a detent, and mating threads. One portion of an example ASRICV can be coupled to another component of the ASRICV and/or to some other component of a system or subsystem by the direct use of one or more coupling features.

In addition, or in the alternative, a portion of an example ASRICV can be coupled to another component of the ASRICV and/or to another component of a system or subsystem using one or more independent devices that interact with one or more coupling features disposed on a component of the example ASRICV. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

If a component of a figure is described but not expressly shown or labeled in that figure, the label used for a corresponding component in another figure may be inferred to that component. Conversely, if a component in a figure is labeled but is not described, the description for such component may be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of ASRICVs will be described more fully hereinafter with reference to the accompanying drawings, in which example embodiments of ASRICVs are shown. ASRICVs may, however, be embodied in many different forms and should not be construed as limited to the example embodiments set forth herein. Rather, these example embodiments are provided so that this disclosure will be thorough and complete, and will fully convey the scope of ASRICVs to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "width,", "height", "depth", "length", "left", "right", "front", "rear", and "within", when present, are used merely to distinguish one component (or part of a component or state of a component or orientation of a component) from another. This list of terms is not exclusive. Such terms are not meant to denote a preference or a particular orientation, and they are not meant to limit embodiments of ASRICVs. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
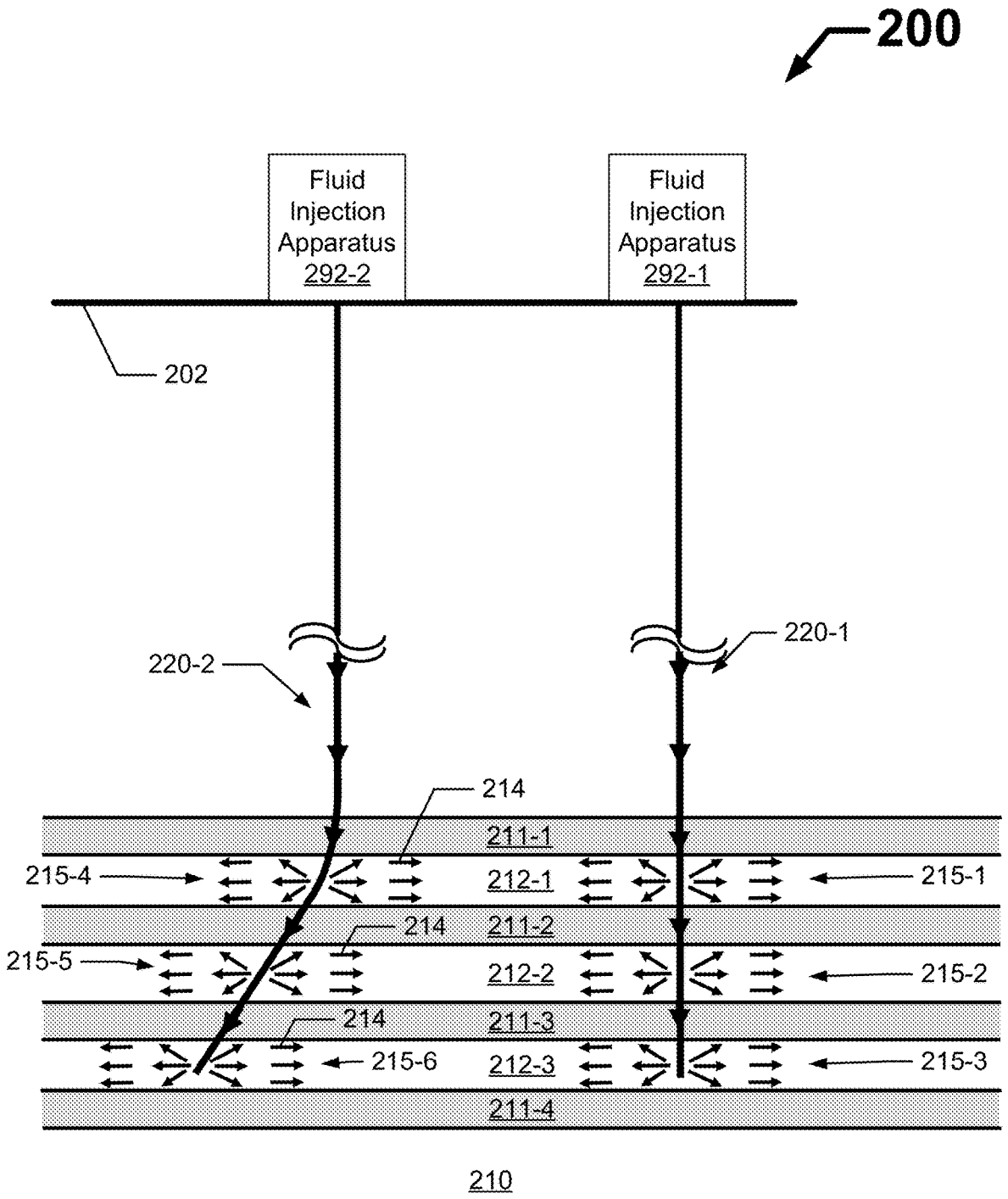

FIGS. 1 and 2 show field systems with which example embodiments can be used. Specifically, FIG. 1 illustrates a field system 100 that includes three wellbores 120 (wellbore 120-1, wellbore 120-2, and wellbore 120-3) that are substantially horizontal and substantially parallel with respect to each other within part (e.g., a layer of shale, a layer of sandstone, a layer of granite) of a subterranean formation 110. Each wellbore 120 has undergone a fracturing operation that has made multiple penetrations along its length in the horizontal section. The fracturing operation of wellbore 120-1 has generated three fracture zones 115 (fracture zone 115-4, fracture zone 115-5, and fracture zone 115-6) within the subterranean formation 110. The fracturing operation of wellbore 120-2 has generated three fracture zones 115 (fracture zone 115-7, fracture zone 115-8, and fracture zone 115-9) within the subterranean formation 110. The fracturing operation of wellbore 120-3 has generated three fracture zones 115 (fracture zone 115-1, fracture zone 115-2, and fracture zone 115-3) within the subterranean formation 110. Fractures created at one wellbore may extend to contact a neighboring wellbore to provide fluid communication. Fractures created at one wellbore may extend to contact fractures created at a neighboring wellbore to provide fluid communication.

As a result of the fracture zones 115 generated by the fracturing operations of the three wellbores 120, and as a result of wellbore 120-1 being positioned between wellbore 120-2 and wellbore 120-3, there are fractures that may provide fluid communication between wellbore 120-3 and wellbore 120-1 and between wellbore 120-2 and wellbore 120-1. Under the scenario shown in FIG. 1, wellbore 120-1 is used as an injection well, where a fluid is injected using a fluid injection apparatus 192 located at or near the surface 102. Also, wellbore 120-2 and wellbore 120-3 are used as extraction wells for a geothermal exchange, where a fluid (e.g., heated water, steam, carbon dioxide) is collected using a fluid collection apparatus 191-1 for wellbore 120-2 and using a fluid collection apparatus 191-2 for wellbore 120-3.

The fluid injection apparatus 192 may include one or more of a number of different equipment to inject fluid into the wellbore 120-1. Examples of such equipment may include, but are not limited to, a pump, a motor, a compressor, a valve, a regulator, a meter, a relay, a controller, piping, a tank, and a power source. Similarly, the fluid collection apparatus 191-1 and the fluid collection apparatus 191-2 may include one or more of a number of different equipment to collect fluid from the wellbore 120-1. Examples of such equipment may include, but are not limited to, a pump, a motor, a compressor, a valve, a regulator, a meter, a relay, a controller, piping, a tank, and a power source.

In this way, fluids (e.g., water, carbon dioxide) that are colder relative to the temperature within the subterranean formation may be injected into the series of hydraulic fractures along the horizontal section of wellbore 120-1. The subterranean formation 110 acts as a heat exchanger as the fluid, shown by the flow paths 114 in FIG. 1, is forced through the fractures toward wellbore 120-2 and wellbore 120-3. The resulting hotter water, steam, or carbon dioxide is harvested from the horizontal sections of wellbore 120-2 and wellbore 120-3, which are in fluid communication with the same fractures.

This arrangement under which the field system 100 of FIG. 1 is configured is generally referred to as an enhanced geothermal system (EGS). Even distribution of injected fluid to the hydraulic fractures allows for harvesting the maximum amount of available geothermal heat. Hydraulic fractures created in identical rock with identical materials and processes typically do not have identical fluid conductivities. This is due to the non-linear nature of hydraulically-driven fracture propagation in subterranean rock formations. It is not uncommon for similarly generated hydraulic fractures to exhibit fluid conductivities spanning an order-of-magnitude difference or some other range of fluid conductivities. As a result, the ability to individually tailor the pressure at which fluid is injected into the various fracture zones 115 (e.g., fracture zone 115-4, fracture zone 115-5, fracture zone 115-6) along the horizontal section of the wellbore 120-1, to account for these differences in fluid conductivities, would generate optimal (e.g., improved) results in harvesting the geothermal resource provided by the subterranean formation 110. As discussed below, use of example embodiments allows for such a tailored approach.

FIG. 2 illustrates another field system 200 that includes two wellbores 220 (wellbore 220-1 and wellbore 220-2), with each wellbore/formation scenario intended as an independent embodiment or application. Wellbore 220-1 is substantially vertical and passes through three impermeable layers 211 (impermeable layer 211-1, impermeable layer 211-2, and impermeable layer 211-3) and three permeable layers 212 (permeable layer 212-1, permeable layer 212-2, and permeable layer 212-3) in the subterranean formation. Permeable layer 212-1 is disposed between impermeable layer 211-1 and impermeable layer 211-2. Permeable layer 212-2 is disposed between impermeable layer 211-2 and impermeable layer 211-3. Permeable layer 212-3 is disposed between impermeable layer 211-3 and another impermeable layer 211-4. The wellbore 220-1 ends within permeable layer 212-3.

Wellbore 220-2 starts as being substantially vertical, and then kicks off at an angle (e.g., 30°, 40°) from vertical above permeable layer 212-1 in the subterranean formation 210. From the kickoff point, the wellbore 220-2 is substantially linear, moving away from wellbore 220-1. Wellbore 220-2 passes through impermeable layer 211-1, permeable layer 212-1, impermeable layer 211-2, permeable layer 212-2, impermeable layer 211-3, and permeable layer 212-3. The wellbore 220-2 ends within permeable layer 212-3.

Each wellbore 220 may or may not have undergone a fracturing operation that has made multiple penetrations within each of the permeable layers 212. In some cases, formation permeability is sufficiently high to obviate the need for hydraulic fracturing. If needed, the fracturing operation of wellbore 220-1 has generated three fracture zones 215. Fracture zone 215-1 is within permeable layer 212-1, fracture zone 215-2 is within permeable layer 212-2, and fracture zone 215-3 is within permeable layer 212-3 of the subterranean formation 210. Similarly, if needed, the fracturing operation of wellbore 220-2 has generated three fracture zones 215. Fracture zone 215-4 is within permeable layer 212-1, fracture zone 215-5 is within permeable layer 212-2, and fracture zone 215-6 is within permeable layer 212-3 of the subterranean formation 210.

As a result of natural formation permeability or of the fracture zones 215 generated by the fracturing operations of the two wellbores 220, fluid communication may be provided within, but not necessarily between, wellbore 220-1 and wellbore 220-2 in permeable layer 212-1, permeable layer 212-2, and permeable layer 212-3. Under the scenario shown in FIG. 2, wellbore 220-1 and wellbore 220-2 are independently used as injection wells that are capable of water, carbon dioxide, and/or some other element or compound being injected through those wellbores 220 and into the various permeable layers 212 of the subterranean formation 210 using a fluid injection apparatus 292-1 for wellbore 220-1 and a fluid injection apparatus 292-2 for wellbore 220-2, both located at or near the surface 202. The fluid injection apparatuses 292 of FIG. 2 may be substantially the same as the fluid injection apparatus 192 of FIG. 1. The flow paths 214 in this case do not overlap between the wellbores 220 since they are independent embodiments or applications. In each embodiment or application, even distribution of the injected material (e.g., water, $CO_2$) within each of the permeable layers 212 is desired in order to allow for maximum storage of injected material or maximum displacement of native formation fluid.

However, due to the non-linear nature of hydraulically-driven fracture propagation in subterranean rock formations, whether within individual permeable layers 212 and/or among the different permeable layers 212, it is not uncommon for similarly generated hydraulic fractures to exhibit fluid conductivities spanning an order-of-magnitude difference or some other range of fluid conductivities. Similarly, unfractured formations can exhibit natural permeabilities spanning an order-of-magnitude difference. As a result, the ability for the pressure at which material injected into the various permeable layers 212 along each wellbore 220 to be individually tailored to account for these differences in fracture conductivities and formation permeabilities would generate optimal (e.g., improved) results in injecting the material into the subterranean formation 210. As discussed below, use of example embodiments allows for such a tailored approach.

Figure 3:
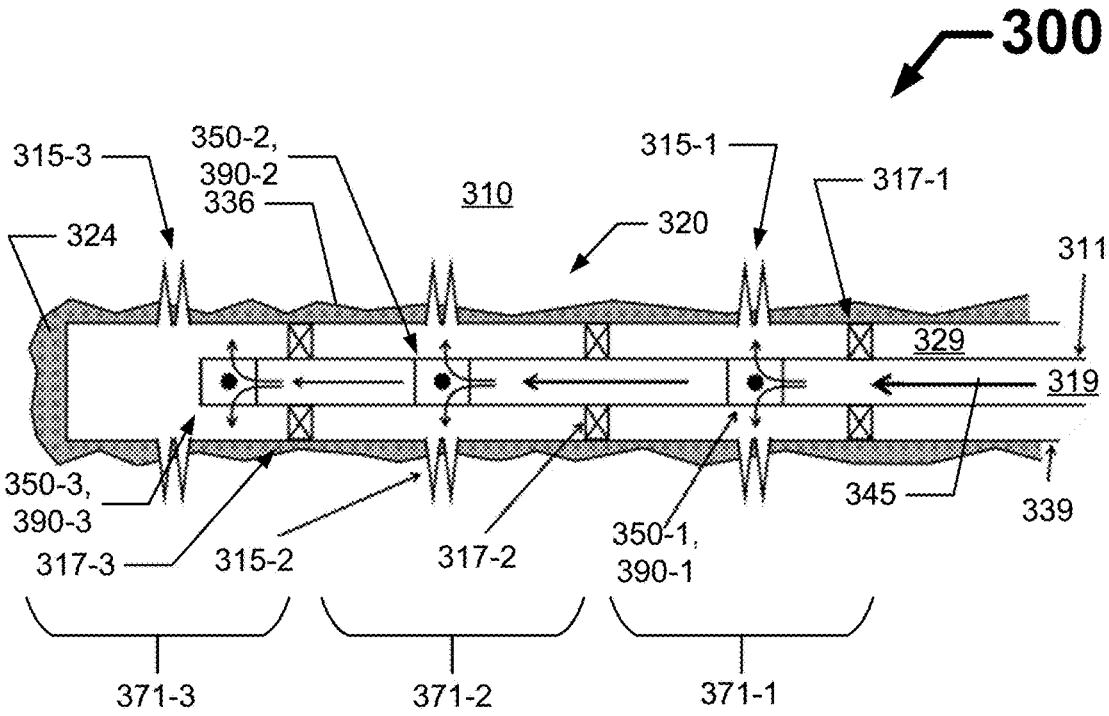
FIG. 3 shows part of a field system for a subterranean operation according to certain example embodiments.

FIG. 3 shows part of a field system 300 for a subterranean operation according to certain example embodiments. Referring to the description of FIGS. 1 and 2, the field system 300 of FIG. 3 includes a cased horizontal section of a wellbore 320 drilled into a subterranean formation 310. In alternative embodiments, the cased section of the wellbore 320 may be at any angle ranging from vertical to horizontal. In this case, there is a casing string 339 inserted into the wellbore 320. The casing string 339 includes a number of casing pipes that are coupled to each other in an end-to-end fashion. The inner diameter of the casing string 339 is larger than the outer diameter of the tubing string 311, forming an annulus 329 therebetween. The tubing string 311 includes a number of tubing pipes that are coupled to each other in an end-to-end fashion. The casing string 339 is adhered to the wall 336 of the wellbore 320 using cement 324.

In addition to the tubing pipes, the tubing string 311 may include one or more of a number (in this example, three) of subs 390 that include example ASRICVs 350. Sub 390-1, which includes ASRICV 350-1, is positioned adjacent to the perforated, and possibly fractured, injection zone 315-1, which allows the fluid 345 to flow therethrough to penetrate part of the casing string 339, part of the cement 324, and part of the subterranean formation 310. Sub 390-2, which includes ASRICV 350-2, is positioned adjacent to the perforated, and possibly fractured, injection zone 315-2, which allows the fluid 345 to flow therethrough to penetrate part of the casing string 339, part of the cement 324, and part of the subterranean formation 310. Sub 390-3, which includes ASRICV 350-3, is positioned adjacent to the perforated, and possibly fractured, injection zone 315-3, which allows the fluid 345 to flow therethrough to penetrate part of the casing string 339, part of the cement 324, and part of the subterranean formation 310.

Each of the subs 390, including their ASRICVs 350, of the field system 300 may be totally or partially isolated from each other within the annulus 329 by inserting one or more packers 317 into the annulus 329, where each packer 317 creates a total or partial seal between the inner perimeter of the casing string 339 and the outer perimeter of the tubing string 311. In this case, there are three packers 317 in the portion of the field system 300 shown in FIG. 3. Packer 317-1 is located upstream of sub 390-1. Packer 317-2 is located between sub 390-1 and sub 390-2. Packer 317-3 is located between sub 390-2 and sub 390-3. Packer 317-1 and packer 317-2 create an isolation zone 371-1 within the annulus 329, where the isolation zone 371-1 includes sub 390-1 (and so also ASRICV 350-1). Packer 317-2 and packer 317-3 create an isolation zone 371-2 within the annulus 329, where the isolation zone 371-2 includes sub 390-2 (and so also ASRICV 350-2). Packer 317-3 and the end of the wellbore 320 create an isolation zone 371-3 within the annulus 329, where the isolation zone 371-3 includes sub 390-3 (and so also ASRICV 350-3).

In certain example embodiments, each ASRICV 350 is configured to operate (e.g., reduce the amount of fluid 345 that flows from its cavity 319 into the annulus 329 (and so into the subterranean formation 310 through the proximate perforated, and possibly fractured, injection zone 315) when a pressure differential (e.g., a difference between the pressure in the cavity 319 within the sub 390 (and so also the associated ASRICV 350) and the pressure in the annulus 329 outside the sub 390)) reaches a minimal threshold value. By using the packers 317, the pressure in the annulus 329 within one isolation zone 371 may differ from the pressure in the annulus 329 within one or more of the other isolation zones 371. As a result, each ASRICV 350 (or otherwise a specific number of ASRICVs 350 as a group or subset) in one isolation zone 371 may perform independently of the ASRICVs 350 in another isolation zone 371. This operational independence of each ASRICV 350 may depend, at least in part, on the ability of one or more of the packers 317 to prevent fluidic communication therethrough within the annulus 329.

When there are multiple subs 390 in the field system 300 (or in any other field system contemplated herein), the configuration aspects (e.g., type of actuator, calibration of the actuator, material, length, inner diameter, types of coupling features) of one sub 390 may be the same as, or different than, one or more of the corresponding configuration aspects of one or more of the other subs 390. A field system 300 may have any number (e.g., one, three, seven, 15, 100) of example subs 390 with ASRICVs 350. An isolation zone 371 in the field system 300 may include any number (e.g., one, two, five, 10, 21) of example subs 390 with ASRICVs 350. The use of example subs 390 with ASRICVs 350 in each isolation zone 371 allows for the substantially even distribution of injected fluids among the isolation zones 371 in the field system 300.

Figure 4:
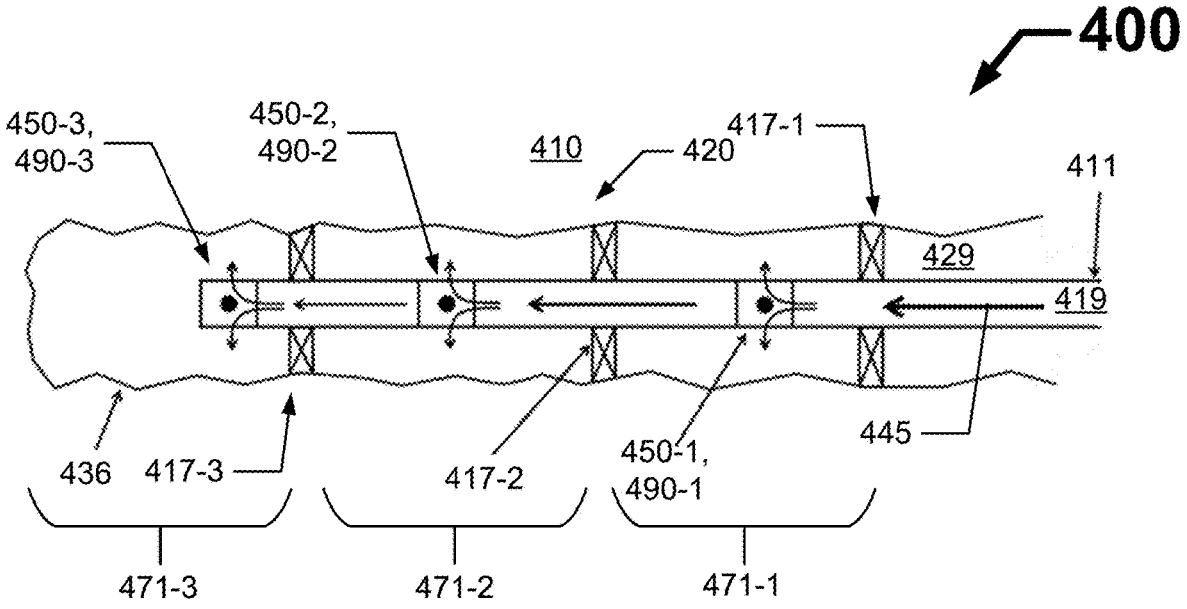
FIG. 4 shows part of another field system for a subterranean operation according to certain example embodiments.

FIG. 4 shows part of another field system 400 for a subterranean operation according to certain example embodiments. Referring to the description of FIGS. 1 through 3, the field system 400 of FIG. 4 includes an open (e.g., not cased) horizontal section of a wellbore 420 drilled into a subterranean formation 410. In alternative embodiments, the open section of the wellbore 420 may be at any angle ranging from vertical to horizontal. In this case, there is no casing string inserted into the wellbore 420. Hydraulically-induced fracture zones may or may not exist in the subterranean formation 410. The tubing string 411 includes a number of tubing pipes that are coupled to each other in an end-to-end fashion.

Each of the subs 490 (and so also the associated ASRICVs 450) of the field system 400 may be totally or partially isolated from each other within the annulus 429 (which in this case is defined as the space between the tubing string 411 and wall 436 of the wellbore 420) by inserting one or more packers 417 into the annulus 429, where each packer 417 creates a total or partial seal between the wall 436 of the wellbore 420 and the outer perimeter of the tubing string 411. In this case, there are three packers 417 in the portion of the field system 400 shown in FIG. 4. Packer 417-1 is located upstream of sub 490-1. Packer 417-2 is located between sub 490-1 and sub 490-2. Packer 417-3 is located between sub 490-2 and sub 490-3. Packer 417-1 and packer 417-2 create an isolation zone 471-1 within the annulus 429, where the isolation zone 471-1 includes sub 490-1 (and so also ASRICV 450-1). Packer 417-2 and packer 417-3 create an isolation zone 471-2 within the annulus 429, where the isolation zone 471-2 includes sub 490-2 (and so also ASRICV 450-2). Packer 417-3 and the end of the wellbore 420 create an isolation zone 471-3 within the annulus 429, where the isolation zone 471-3 includes sub 490-3 (and so also ASRICV 450-3).

In certain example embodiments, each ASRICV 450 is configured to operate (e.g., reduce the amount of fluid 445 that flows from its cavity 419 into the annulus 429 (and so into the subterranean formation 410)) when a pressure differential (e.g., a difference between the pressure in the cavity 419 within the sub 490 (and so also the associated ASRICV 450) and the pressure in the annulus 429 outside the sub 490) reaches a minimal threshold value. By using the packers 417, the pressure in the annulus 429 within one isolation zone 471 may differ from the pressure in the annulus 429 within one or more of the other isolation zones 471. As a result, each ASRICV 450 (or otherwise a specific number of ASRICVs 450 as a group or subset) in one isolation zone 471 may perform independently of the ASRICVs 450 in another isolation zone 471. This operational independence of each ASRICV 450 may depend, at least in part, on the ability of one or more of the packers 417 to prevent fluidic communication therethrough within the annulus 429. The use of example subs 490 with ASRICVs 450 in each isolation zone 471 allows for the substantially even distribution of injected fluids among the isolation zones 471 in the field system 400.

Figure 5A:
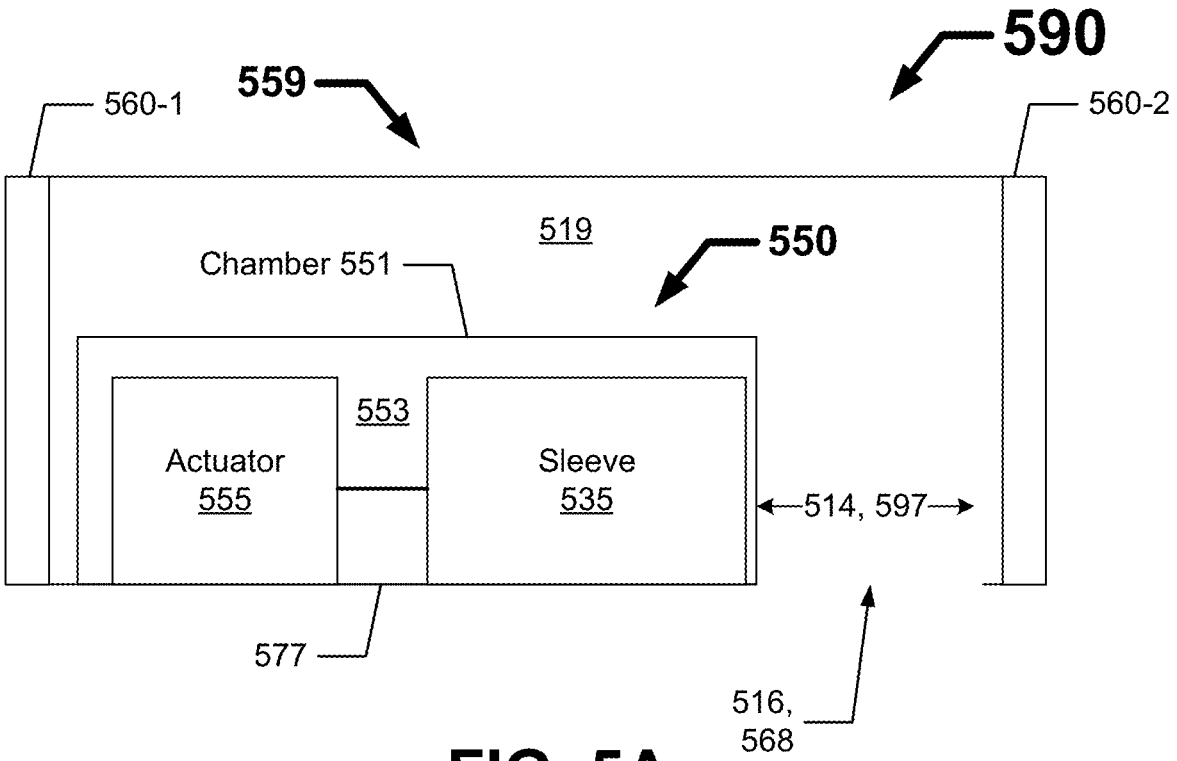
FIGS. 5A and 5B show a block diagram of a sub that includes an ASRICV according to certain example embodiments.
Figure 5B:
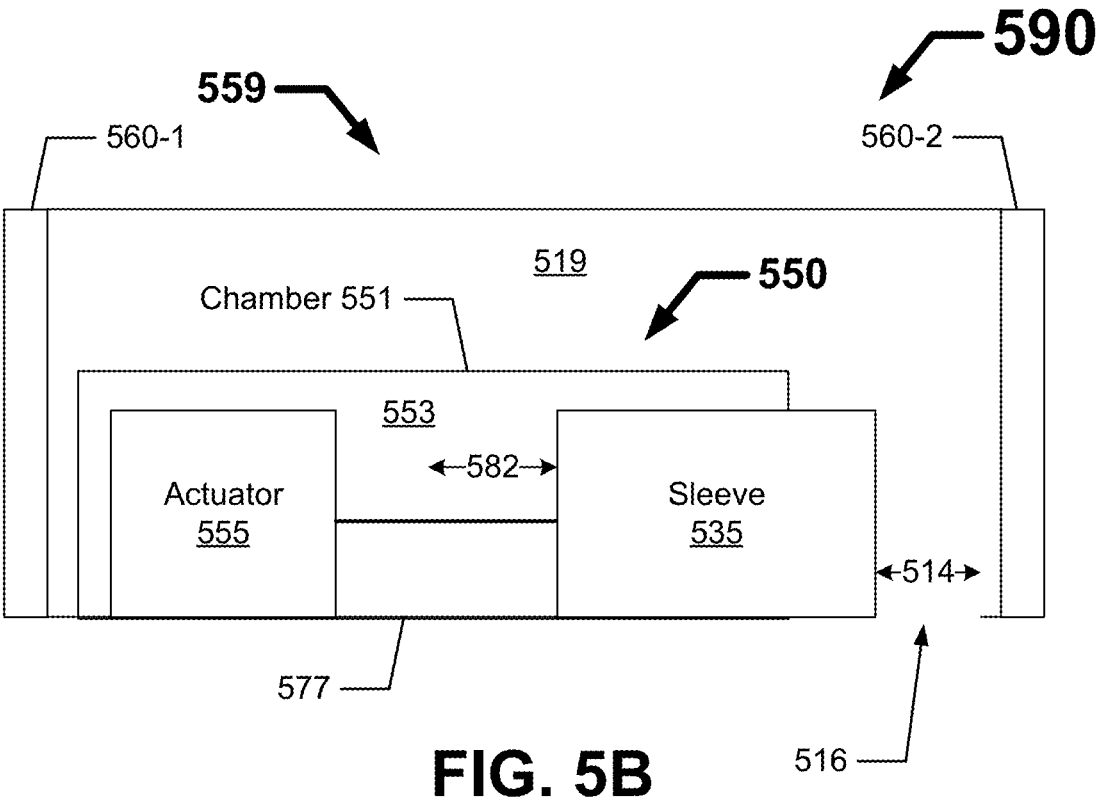

FIGS. 5A and 5B show a block diagram of a sub 590 that includes an ASRICV 550 according to certain example embodiments. Referring to the description of FIGS. 1 through 4 above, the ASRICV 550 of the sub 590 is shown in an open position in FIG. 5A and in a closed position in FIG. 5B. The sub 590 includes a housing 559 that includes one or more housing walls 577, inside of which is disposed an ASRICV 550. The ASRICV 550 in this case includes a chamber 551, an actuator 555, and a sleeve 535, where the actuator 555 and the sleeve 535 are located within the chamber 551.

The housing 559 includes one or more walls 577 that form a cavity 519 that is open at both ends. One or more of the walls 577 of the housing 559 also has one or more flow orifices 568 that traverse therethrough. Each flow orifice 568 has a footprint 597 (e.g., a width, a cross-sectional shape, a length) that is sufficient to allow for the flow of a fluid (e.g., fluid 445) therethrough. Each flow orifice 568 may also have other characteristics (e.g., length, meshing) that is sufficient to allow for the flow of a fluid (e.g., fluid 445) therethrough. The housing 559 may have any shape (e.g., cylindrical) and size (e.g., inner diameter, outer diameter) to allow the sub 590 (and so also the ASRICV 550) to be substantially seamlessly incorporated into a tubing string (e.g., tubing string 311) used in a field operation within a wellbore (e.g., wellbore 320).

In addition, the housing 559 may include one or more coupling features 560 to allow the housing 559 to be coupled to another component (e.g., a tubing pipe, a sub) of a tubing string. In this case, the housing 559 includes two coupling features 560, where one coupling feature 560-1 is located at one end of the housing 559, and the other coupling feature 560-2 is located at the opposite end of the housing 559. The housing 559 may be made of one or more of any of a number of materials (e.g., steel) that are designed to withstand the conditions (e.g., temperature, pressure, flow rate) that exist in a wellbore during a field operation.

The chamber 551 of the ASRICV 550 includes one or more walls that form a cavity 553. In certain example embodiments, the cavity 553 of the chamber 551 is smaller than the cavity 519 of the housing 559. In certain example embodiments, the cavity 553 of the chamber 551 is a subset of the cavity 519 of the housing 559. One or more of the walls of the chamber 551 may also serve as one or more of the walls 577 of the housing 559 of the sub 590. The chamber 551 may be configured to have disposed in the cavity 553 the actuator 555 and the sleeve 535. In certain example embodiments, the sleeve 535 is configured to move within the chamber 551 when the actuator 555 operates.

In some cases, the chamber 551 has at least one opening therein. For example, the chamber 551 may have an open distal end through which part of the sleeve 535 may move. In such cases, the chamber 551 does not extend into or beyond the flow orifice 568 in the wall 577 of the housing 559. As another example, the chamber 551 may have a flow orifice that traverses the thickness of one or more of the walls (e.g., the outer wall, the inner wall) of the chamber 551. In such cases, the flow orifice in the wall of the chamber 551 may be coincident (e.g., vertically aligned) with the flow orifice 568 in the wall 577 of the housing 559 of the sub 590.

In certain example embodiments, the chamber 551 of the ASRICV 550 is configured to include one or more features that allow for the sleeve 535 to move therein consistently, reliably, and with a minimal amount of resistance. For example, the inner surface of one or more walls of the chamber 551 and/or an inner surface of a wall 577 of the housing 559 that helps form the cavity 553 of the chamber 551 may include one or more protrusions that act as tracks along which the sleeve 535 may slide in both directions.

The actuator 555 of the ASRICV 550 is configured to move the sleeve 535 within the chamber 551 based on conditions within the cavity 519 of the sub 590 and/or outside the sub 590. For example, the actuator 555 may operate based on a differential in pressure within the cavity 519 of the sub 590 and outside the sub 590 exceeding a minimum threshold value. The actuator 555 may include one or more of a number of components. For example, as discussed below with respect to FIGS. 6 through 7B, the actuator 555 may include a spring or other form of resilient device. As another example, as discussed below with respect to FIGS. 10 through 11B, the actuator 555 may include a gas held in part of the chamber 551. In certain example embodiments, the actuator 555 operates without any external controller and/or without any electrical components.

The actuator 555 may be configured, when operated, to actively and/or passively move the sleeve 535 forward and/or backward within the chamber 551. In some cases, the distal end of the sleeve 535 may extend beyond the distal end of the housing 559. In certain example embodiments, the actuator 555 may have a direct or indirect limit as to how far forward and/or backward within the chamber 551 the sleeve 535 may be moved when the actuator 555 is actuated. In some cases, the actuator 555 may directly or indirectly be limited in moving the sleeve 535 forward within the chamber 551 so that the flow orifice 568 in the wall 577 of the housing 559 (and any flow orifice of the chamber 551) is only partially, and not completely, obstructed. In certain example embodiments, the actuator 555 is self-regulating, operating based on real-time conditions within a wellbore.

The sleeve 535 of the ASRICV 550 is configured to move within the chamber 551 to partially obstruct the flow orifice 568 in the wall 577 of the housing 559 (and/or any flow orifice of the chamber 551) when certain conditions are met in real time within the wellbore. When the sleeve 535 does not obstruct the flow orifice 568 in the wall 577 of the housing 559 (and any flow orifice of the chamber 551), the sleeve 535 is in an open position. When the sleeve 535 is in the open position, the footprint 597 of the flow orifice 568 in the wall 577 of the housing 559 (and any flow orifice of the chamber 551) may be substantially the same as the effective footprint 514 of the collective flow orifice 516.

When the sleeve 535 partially obstructs the flow orifice 568 in the wall 577 of the housing 559 (and any flow orifice of the chamber 551), the sleeve 535 is in a closed position. In certain example embodiments, the sleeve 535 may have one open position and a number of closed positions, where each closed position may be based on the extent to which the flow orifice 568 in the wall 577 of the housing 559 (and any flow orifice of the chamber 551) is obstructed by the sleeve 535. The multiple closed positions of the sleeve 535 may be discrete or continuous within the range of motion $\Delta x$ 582 of the sleeve 535.

When the sleeve 535 is in a closed position, the sleeve 535 decreases the effective footprint 514 of the collective flow orifice 516, where the effective footprint 514 is less than the footprint 597 of the flow orifice 568 in the wall 577 of the housing 559 (and any flow orifice of the chamber 551). When the sleeve 535 is in the maximally closed position, the sleeve 535 may not further obstruct or cover the flow orifice 568 in the wall 577 of the housing 559 (and any flow orifice of the chamber 551), and so the effective footprint 514 of the collective flow orifice 516 at that point is the smallest possible size allowed under the configuration of the ASRICV 550. As discussed above, in certain example embodiments, the ASRICV 550 may be configured so that the flow orifice 568 in the wall 577 of the housing 559 (and any flow orifice of the chamber 551) is never completely obstructed or covered by the sleeve 535, and so the effective footprint 514 of the collective flow orifice 516 is always greater than zero in such cases.

The configuration of the ASRICV 550 may dictate the configuration of the sleeve 535. For example, as discussed above, the distal end of the sleeve 535 may be configured as a solid piece. In such case, the distal end of the sleeve 535 may be configured to avoid obstructing or covering the flow orifice 568 in the wall 577 of the housing 559 (and any flow orifice of the chamber 551) when the sleeve 535 is in the open position. By contrast, the distal end of the sleeve 535 is configured to partially obstruct or cover the flow orifice 568 in the wall 577 of the housing 559 (and any flow orifice of the chamber 551) when the sleeve 535 is in a closed position.

As another example, the sleeve 535 may have a flow orifice that traverses the thickness of the sleeve 535 toward its distal end. In such a case, the footprint of the flow orifice of the sleeve 535 may fully or partially align with the footprint 597 of the flow orifice 568 in the wall 577 of the housing 559 (and the footprint of any flow orifice of the chamber 551) when the sleeve 535 is in the open position. By contrast, the footprint of the flow orifice of the sleeve 535 may partially obstruct or cover the footprint 597 of the flow orifice 568 in the wall 577 of the housing 559 (and the footprint of any flow orifice of the chamber 551) when the sleeve 535 is in a closed position.

In certain example embodiments, each ASRICV 550 (including components thereof, such as the actuator 555 and the sleeve 535) is configured to function during a field operation in a wellbore. For example, as a fluid is being pumped at a high pressure and flow rate through the cavity of the tubing string, the actuator 555 may operate to move the sleeve 535 between the open position and any of a number of closed positions in real time based on running conditions (e.g., pressure, temperature) in the wellbore.

Figure 6:
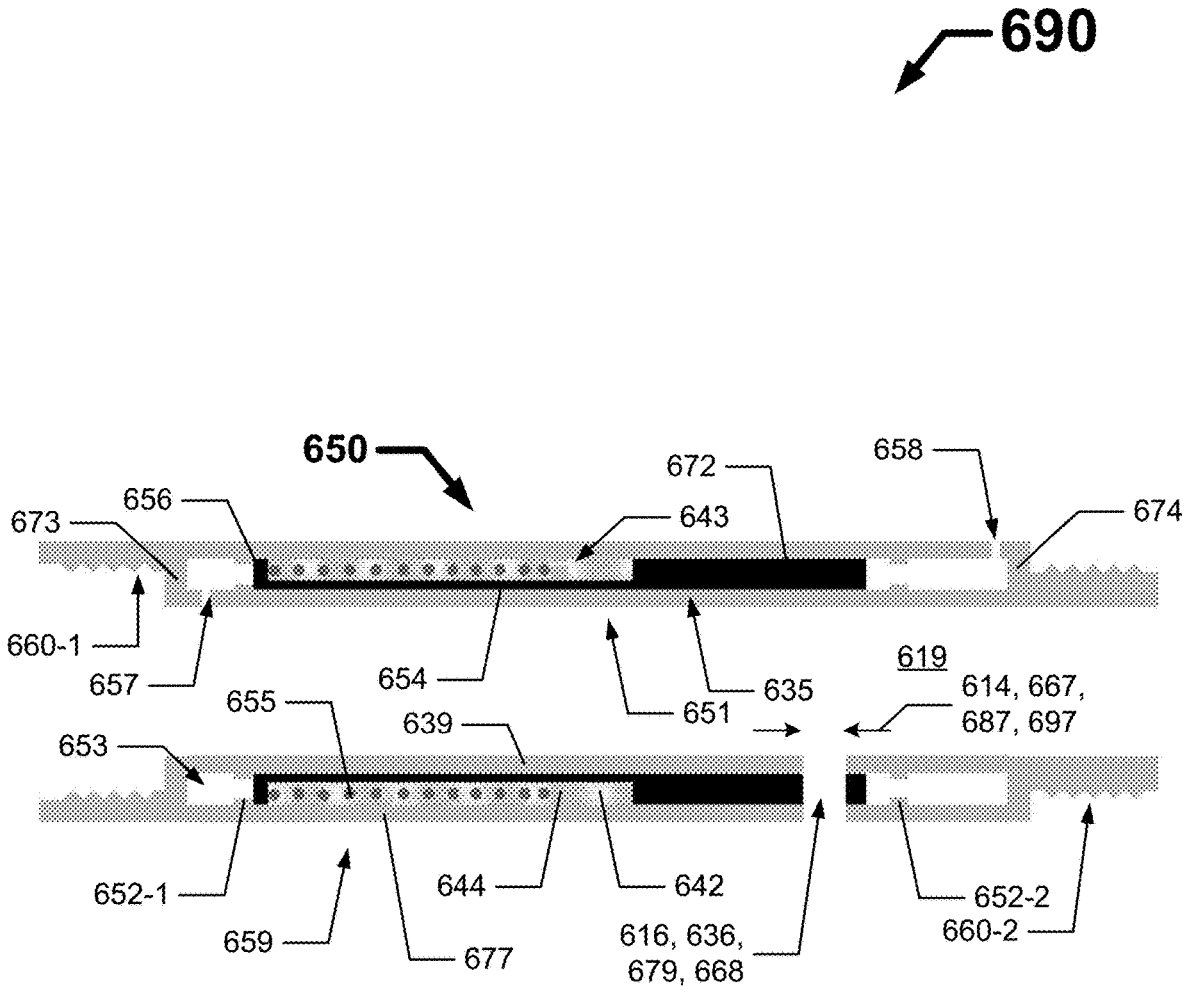
FIG. 6 shows a sectional side view of a sub that includes an ASRICV according to certain example embodiments.
Figure 7A:
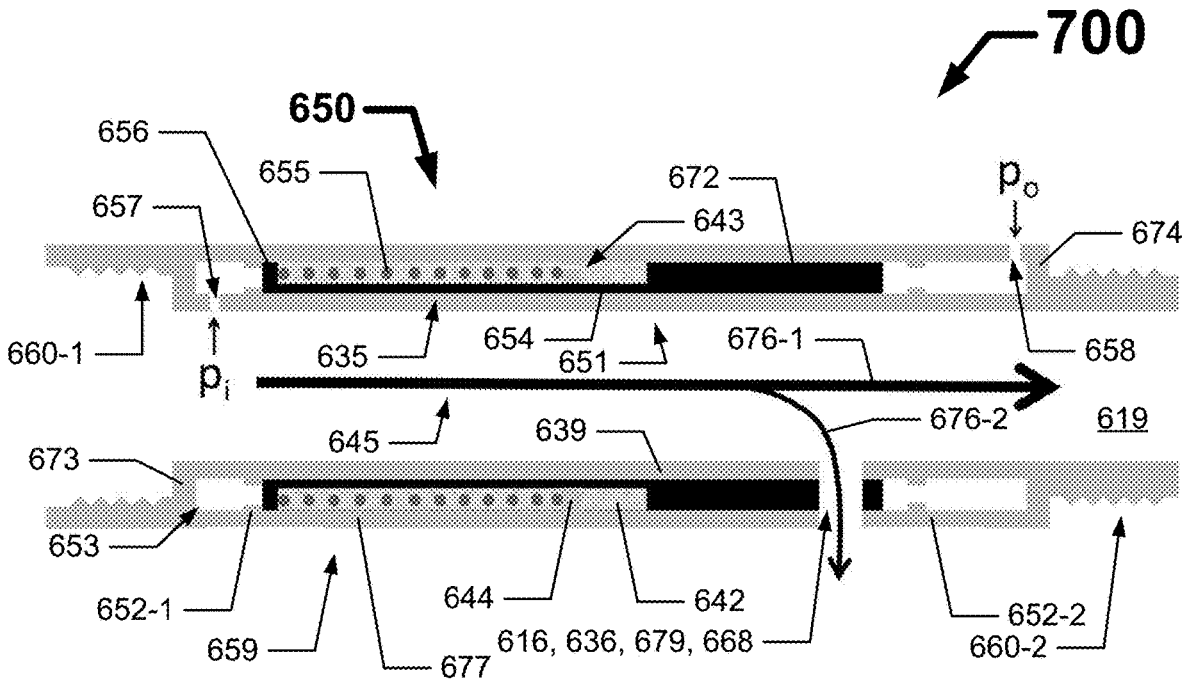
FIGS. 7A and 7B show part of yet another field system that includes the sub of FIG. 6 that includes the ASRICV according to certain example embodiments.
Figure 7B:
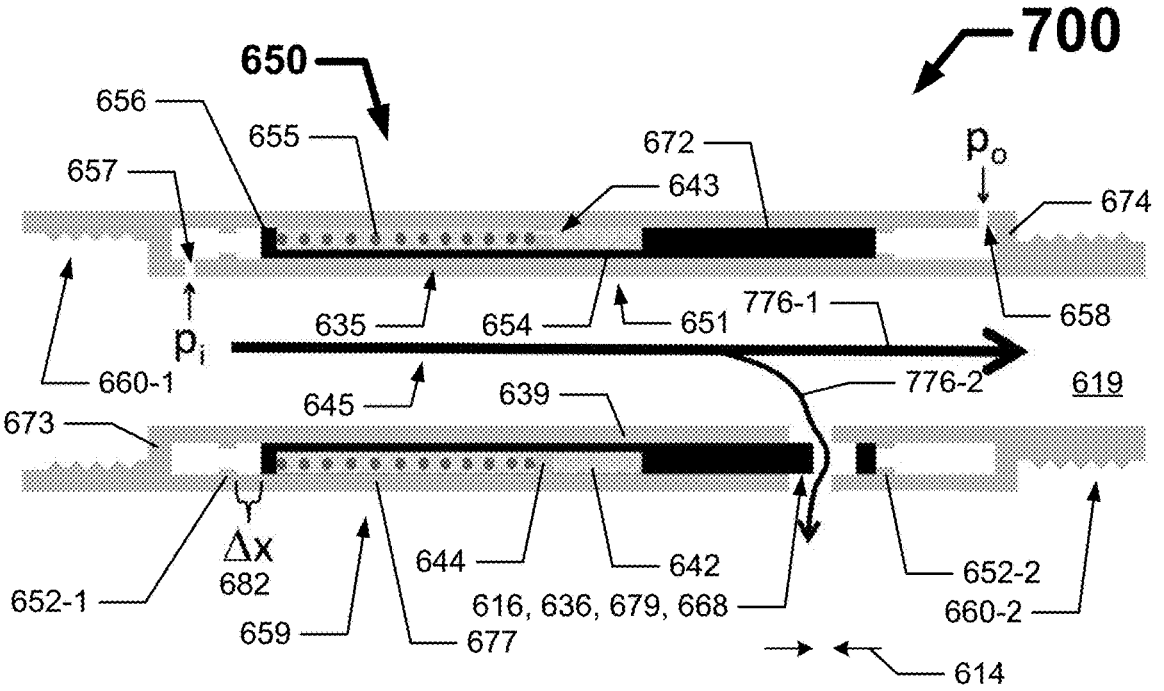

FIG. 6 shows a sectional side view of a sub 690 that includes an ASRICV 650 according to certain example embodiments. FIGS. 7A and 7B show part of yet another field system 700 that includes the sub 690 of FIG. 6 that includes the ASRICV 650 with the sleeve 635 in the open position and a closed position, respectively, according to certain example embodiments. Referring to the description of FIGS. 1 through 5 above, the example sub 690 of FIG. 6 includes a housing 659 and an ASRICV 650. The ASRICV 650 in this case includes a chamber 651, an actuator 655, and a sleeve 635, where the actuator 655 and the sleeve 635 are located within the chamber 651.

The housing 659 includes an outer wall 677 that forms a cavity 619 that is open at both ends. The wall 677 of the housing 659 also has a flow orifice 668 that traverses therethrough at the bottom of the housing 659. The flow orifice 668 has a footprint 697 (e.g., a width, a cross-sectional shape, a length) that is sufficient to allow for the flow of a fluid (as shown in FIGS. 7A and 7B below) therethrough. The housing 659 in this case is cylindrical in shape and has a size (e.g., inner diameter, outer diameter) to allow the sub 690 (and so also the ASRICV 650) to be substantially seamlessly incorporated into a tubing string (e.g., tubing string 311) used in a field operation within a wellbore (e.g., wellbore 320).

In addition, the housing 659 of the sub 690 in this example includes one coupling feature 660-1 in the form of mating threads located at one end (e.g., the left or upstream end) of the housing 659, as well as another coupling feature 660-2 in the form of mating threads located at the opposite end of the housing 659. These coupling features 660 allow the sub 690 to be coupled to two other components of a tubing string. The housing 659 may be made of one or more of any of a number of materials (e.g., steel) that are designed to withstand the conditions (e.g., temperature, pressure, flow rate) that exist in a wellbore during a field operation.

The chamber 651 of the ASRICV 650 includes an inner wall 639, a proximal wall 673, and a distal wall 674 that form a cavity 653. The wall 677 of the housing 659 also serves as the outer wall of the chamber 651. In this case, the cavity 653 of the chamber 651 is smaller than the cavity 619 of the housing 659. Also, in this case, aside from the internal pressure port 657 (discussed below), the cavity 653 of the chamber 651 is isolated from the cavity 619 of the housing 659. The actuator 655 and the sleeve 635 are disposed in the cavity 653 of the chamber 651 in this case. The sleeve 635 is configured to move within part of the cavity 653 of the chamber 651 when the actuator 655 operates.

The inner wall 639 of the chamber 651 has a flow orifice 679 that traverses the thickness of the wall 639. The flow orifice 679 in the inner wall 639 of the chamber 651 in this example is coincident (e.g., vertically aligned) with the flow orifice 668 in the wall 677 of the housing 659 of the sub 690. The flow orifice 679 has a footprint 687 (e.g., a width, a cross-sectional shape, a length) that is substantially the same as the footprint 697 of the flow orifice 668 in the wall 677 of the housing 659. In alternative embodiments, the footprint 687 of the flow orifice 679 may differ from one or more characteristics of the footprint 697 of the flow orifice 668.

The actuator 655 of the ASRICV 650 is configured to move the sleeve 635 within the chamber 651 based on a differential in pressure between the cavity 619 ($p_i$) of the sub 690 and outside ($p_o$) the sub 690. The actuator 655 in this case includes a single component in the form of a resilient device (e.g., a spring). The actuator 655 operates without any external controller and/or without any electrical components. Specifically, in this case, the actuator 655 is positioned within a part of the cavity 653 of the chamber 651 in a space 642 defined by the outer wall 677 of the housing 659, the proximal end of the distal wall 672 of the sleeve 635, part of an inner wall 654 of the sleeve 635, and a proximal wall 656 of the sleeve 635. The spring of the actuator 655 is located within the space 642 against an internal side wall 644 that extends laterally inward from the outer wall 677 of the housing 659 and is positioned upstream from the proximal end of the distal wall 672 of the sleeve 635.

The space 642 in which the actuator 655 is positioned may be filled with air, any other fluid, and/or any other material to ensure reliable operation of the actuator 655 over time. The side wall 644 in this case includes one or more motion dampening orifices 643 that traverse therethrough. Each motion dampening orifice 643 may be configured (e.g., have a width, have a cross-sectional shape) in such a way as to ensure reliable operation of the actuator 655 over time. If there are multiple motion dampening orifices 643, the configuration of one motion dampening orifice 643 may be the same as, or different than, the configuration of one or more of the other motion dampening orifices 643. The size of the space 642 does not vary in this example as the sleeve 635 moves within the chamber 651. The changing position of sleeve 635 forces the fluid contained in the space 642 to move through a motion dampening orifice 643. Regardless of the position of the sleeve 635 within the chamber 651, the volume of the space 642 that contains the fluid remains constant.

The actuator 655 in this example is configured, when operated, to move the sleeve 635 forward and/or backward within the chamber 651. In this case, the distal wall 672 of the sleeve 635 has a flow orifice 636 that traverses the thickness of the distal wall 672. When the sleeve 635 is in the open position, the flow orifice 636 of the sleeve 635 is coincident (e.g., vertically aligned) with the flow orifice 668 in the wall 677 of the housing 659 of the sub 690 and with the flow orifice 679 that traverses the thickness of the wall 639 of the chamber 651. The flow orifice 636 of the sleeve 635 has a footprint 667 (e.g., a width, a cross-sectional shape, a length) that is substantially the same as the footprint 697 of the flow orifice 668 in the wall 677 of the housing 659 and as the footprint 687 of the flow orifice 679 of the inner wall 639 of the chamber 651. In alternative embodiments, the footprint 667 of the flow orifice 636 may differ from one or more characteristics of the footprint 697 of the flow orifice 668 and/or of the footprint 687 of the flow orifice 679.

If the sleeve 635 is freely rotatable within the chamber 651, the flow orifice 636 may extend around some or all of the sleeve 635. For example, in such case, the flow orifice 636 may include a series of rectangular openings (when viewed from above) where adjacent openings have a thin portion of the distal wall 672 of the sleeve 635 positioned therebetween. In alternative embodiments, the sleeve 635 and/or one or more portions (e.g., the inner wall 639, the proximal wall 673) of the chamber 651 may include one or more of a number of features (e.g., protrusions, recesses, detents, slots, tabs) that prevent the sleeve 635 from rotating within the chamber 651. In this way, the distal wall 672 of the sleeve 635 may have a flow orifice 636 in the form of a single opening that traverses the thickness of the distal wall 672.

In any case, the characteristics (e.g., cross-sectional shape, length, width) of the footprint 667 of the flow orifice 636 of the sleeve 635 may be substantially similar to the corresponding characteristics of the footprint 687 of the flow orifice 679 of the inner wall 639 of the chamber 651 and/or the corresponding characteristics of the footprint 697 of the flow orifice 668 in the wall 677 of the housing 659. In this way, when the sleeve 635 is in the fully open position, the characteristics of the effective footprint 614 of the collective flow orifice 616 is substantially the same as the corresponding characteristics of the footprint 667 of the flow orifice 636, the footprint 687 of the flow orifice 679, and the footprint 697 of the flow orifice 668.

The overlap of the flow orifice 679 of the inner wall 639 of the chamber 651, the flow orifice 636 of the sleeve 635, and the flow orifice 668 in the wall 677 of the housing 659 results in a collective orifice 616 having an effective footprint 614. As a result, when the sleeve 635 is in the open position, the effective footprint 614 of the collective orifice 616 is substantially the same as the footprint 667 of the flow orifice 636 of the sleeve 635, the footprint 697 of the flow orifice 668 in the wall 677 of the housing 659, and the footprint 687 of the flow orifice 679 of the inner wall 639 of the chamber 651. As shown in FIG. 7A, in such cases when the sleeve 635 is in the open position, a maximum portion 676-2 of a fluid 645 flowing through the cavity 619 of the housing 659 is diverted through the collective orifice 616 to a subterranean formation while a remaining portion 676-1 of the fluid 645 continues to flow out the opposite end of the housing 659.

As the actuator 655 operates to move the sleeve 635 to a closed position from the open position, as shown in FIG. 7B, the flow orifice 636 of the sleeve 635 is no longer coincident (e.g., is no longer vertically aligned) with the flow orifice 668 in the wall 677 of the housing 659 of the sub 690 and with the flow orifice 679 that traverses the thickness of the wall 639 of the chamber 651. As a result, the effective footprint 614 of the collective orifice 616 is reduced, which results in a lesser portion 776-2 (where the amount of the portion 776-2 is less than the portion 676-2 of FIG. 7A) of the fluid 645 flowing through the cavity 619 of the housing 659 is diverted through the collective orifice 616 to the subterranean formation while a remaining portion 776-1 (where the amount of the portion 776-1 is greater than the amount of the portion 676-1) of the fluid 645 continues to flow out the opposite end of the housing 659.

As discussed above, the actuator 655 operates when the difference between the internal pressure ($p_i$) (in this case, the pressure within the cavity 619) and the external pressure ($p_o$) [i.e., Δp] exceeds a minimum threshold value. When the actuator 655 operates, the sleeve 635 moves to control the effective footprint 614 of the collective flow orifice 616 and, ultimately, the flowrate at which a portion (e.g., 676-2, 776-2) of the fluid 645 exits the sub 690. In this example, the resultant forces from Δp act axially on the sleeve 635. The various characteristics of the actuator 655 (specifically, the spring) in this case may be selected by a user so that the actuator 655 operates in the manner desired. For example, the preload force imposed by the spring may be used to control the point at which Δp is sufficiently large to operate the actuator 655 and move the sleeve 635. The compression stiffness of the spring may be used to control the rate at which the sleeve 635 moves with changes in Δp.

The ASRICV 650 in this case is configured to operate autonomously based on the Δp that the sleeve 635 and, in turn, the actuator 655 of the ASRICV 650 experiences locally. As a result, by moving the sleeve 635 in a controlled fashion, the actuator 655 (and so the ASRICV 650 in general) self-regulates fluid flow in response to changes in Δp. FIGS. 7A and 7B illustrate the sleeve 635 in its fully-open (Δx 682=0) and maximally-closed (Δx 682=max) positions, respectively, where Δx 682 represents the position of the sleeve 635 relative to the fully open position. In order for the actuator 655 to experience the pressure differential, the ASRICV 650 may include one or more of a number of features. For example, in this case, the ASRICV 650 includes an internal pressure port 657 (corresponding to $p_i$) and an external pressure port 658 (corresponding to $p_o$). In alternative embodiments, the ASRICV 650 may include multiple internal pressure ports 657 and/or multiple external pressure ports 658.

The internal pressure port 657 is located in this example in the inner wall 639 of the chamber 651 adjacent to the proximal wall 673 of the chamber 651 and upstream of the proximal wall 656 of the sleeve 635. The internal pressure port 657 may have any of a number of configurations. In this case, the internal pressure port 657 is a relatively small circular hole that traverses the thickness of the inner wall 639 of the chamber 651. The external pressure port 658 is located in this example in the outer wall 677 of the housing 659 adjacent to the distal wall 674 of the chamber 651 and downstream of the distal wall 672 of the sleeve 635. The external pressure port 658 may have any of a number of configurations. In this case, the external pressure port 658 is a relatively small circular hole that traverses the thickness of the outer wall 677 of the housing 659.

When the pressure ($p_i$) at the internal pressure port 657 exceeds the pressure ($p_o$) at the external pressure port 658, the differential pressure ($\Delta p = p_i - p_o$) acting against opposite ends (i.e., the proximal wall 656 and the distal wall 672) of the sleeve 635 applies a net force directed downstream. Initially, when the differential between the pressure ($p_i$) and the pressure ($p_o$) is relatively low, the upstream force of the spring of the actuator 655 applied to the proximal wall 656 of the sleeve 635 exceeds the net downstream force imposed by Δp acting against opposite ends (i.e., the proximal wall 656 and the distal wall 672) of the sleeve 635. As a result, the sleeve 635 remains stationary.

When the pressure ($p_i$) at the internal pressure port 657 exceeds the pressure ($p_o$) at the external pressure port 658 by a certain amount (e.g., the minimum threshold pressure amount), then the net downstream force imposed by Δp acting against opposite ends (i.e., the proximal wall 656 and the distal wall 672) of the sleeve 635 exceeds the upstream force of the spring of the actuator 655 applied to the proximal wall 656 of the sleeve 635. As a result, the sleeve 635 moves downstream. The amount of downstream movement of the sleeve 635 (in other words, the extent to which the sleeve 635 is in a closed position) depends on the extent to which the internal pressure ($p_i$) exceeds the external pressure ($p_o$).

When the differential between the internal pressure ($p_i$) and the external pressure ($p_o$) decreases, the upstream force applied by the spring of the actuator 655 may overcome the net downstream force imposed by Δp acting against opposite ends (i.e., the proximal wall 656 and the distal wall 672) of the sleeve 635, causing the sleeve 635 to return to the open position within the chamber 651. Since the spring of the actuator 655 is reacting in real time to the pressure differential experienced by the sub 690, the position of the sleeve 635 is being adjusted in real time by the actuator 655. When the pressure differential is sufficiently high, the position of the sleeve 635 reduces the amount of the portion 776-2 of the fluid 645 that flows through the collective orifice 616 out of the sub 690 by reducing the effective footprint 614 of the collective orifice 616. Conversely, when the pressure differential is relatively minimal, the position of the sleeve 635 is such that the sleeve 635 has little to no impact on the effective footprint 614 of the collective orifice 616, and so the effective footprint 614 is substantially the same as the footprint 667 of the flow orifice 636 of the sleeve 635. As a result, the amount of the portion 676-2 of the fluid 645 that flows through the collective orifice 616 out of the sub 690 is at a maximum.

In order to limit the range of the motion of the sleeve 635 by the actuator 655, the ASRICV 650 may include one or more stops 652. In this case, the ASRICV 650 has two stops 652. Stop 652-1 in this case is in the form of one or more protrusions that extend toward the cavity 653 of the chamber 651 from the outer wall 677 of the housing 659 and/or from the inner wall 639 of the chamber 651 around some or all of the perimeter of the chamber 651. The stop 652-1 in this case is positioned slightly downstream of the internal pressure port 657 within the cavity 653 of the chamber 651.

The distance between the protrusions of the stop 652-1 may be less than the thickness of the proximal wall 656 of the sleeve 635. In this way, the stop 652-1 prevents the sleeve 635 from traveling further upstream within the cavity 653 of the chamber 651. The position of the stop 652-1 within the cavity 653 of the chamber 651 in this case means that, when the proximal wall 656 of the sleeve 635 abuts against the stop 652-1, the flow orifice 636 that traverses the thickness of the distal wall 672 of the sleeve 635 is substantially aligned with (coincident with) the flow orifice 679 and the flow orifice 668. Also, the distance between the protrusions of the stop 652-1 may be large enough to allow the internal pressure ($p_i$) that enters the cavity 653 of the chamber 651 through the internal pressure port 657 to be communicated downstream of the stop 652-1 to the proximal wall 656 of the sleeve 635.

Stop 652-2 in this case is also in the form of one or more protrusions that extend toward the cavity 653 of the chamber 651 from the outer wall 677 of the housing 659 and/or from the inner wall 639 of the chamber 651 around some or all of the perimeter of the chamber 651. The stop 652-2 in this case is positioned slightly upstream of the external pressure port 658 within the cavity 653 of the chamber 651. The distance between the protrusions of the stop 652-2 may be less than the thickness of the distal wall 672 of the sleeve 635. In this way, the stop 652-2 prevents the sleeve 635 from traveling further downstream within the cavity 653 of the chamber 651.

The position of the stop 652-2 within the cavity 653 of the chamber 651 in this case means that, when the distal wall 672 of the sleeve 635 abuts against the stop 652-2, the flow orifice 636 that traverses the thickness of the distal wall 672 of the sleeve 635 does not completely overlap or cover the flow orifice 679 and the flow orifice 668. In this way, when the sleeve is in the maximally closed position, the effective footprint 614 of the collective orifice 616 is greater than zero. Also, the distance between the protrusions of the stop 652-2 may be large enough to allow the external pressure ($p_o$) that enters the distal end of the cavity 653 of the chamber 651 through the external pressure port 658 to be communicated upstream of the stop 652-2 to the distal wall 672 of the sleeve 635.

The configuration of a stop 652 may differ from what is shown and described herein to achieve the purpose of the stop 652 in limiting the range of travel of the sleeve 635. For example, a stop 652 may be or include a single protrusion rather than a pair of protrusions. As another example, a stop 652 may be or include one or more protrusions that extend inward (downstream) from the proximal wall 673 of the chamber. When the ASRICV 650 of the sub 690 has multiple stops 652, as in this case, the configuration of one stop 652 may be the same as, or different than, the configuration of one or more of the other stops 652.

As discussed above, the distal wall 672 of the sleeve 635 of the ASRICV 650 is configured to move within the chamber 651 to partially obstruct the flow orifice 668 of the housing 659 and the flow orifice 679 in the inner wall 639 of the chamber 651 when a minimum pressure differential occurs relative to the sub 690. When the sleeve 635 does not substantially obstruct the flow orifice 668 of the housing 659 and the flow orifice 679 in the inner wall 639 of the chamber 651, the sleeve 635 is in the open position. When the sleeve 635 is in the open position, the effective footprint 614 of the collective flow orifice 616 is substantially the same as the corresponding characteristics of the footprint 667 of the flow orifice 636, the footprint 687 of the flow orifice 679, and the footprint 697 of the flow orifice 668.

When the sleeve 635 partially obstructs the flow orifice 668 of the housing 659 and the flow orifice 679 of the inner wall 639 of the chamber 651, the sleeve 635 is in a closed position. In certain example embodiments, the sleeve 635 may have a number of closed positions, where each closed position is based on the extent to which the flow orifice 668 of the housing 659 and the flow orifice 679 of the inner wall 639 of the chamber 651 is obstructed by the sleeve 635, which in turn is based on the amount of differential pressure relative to the sub 690.

When the sleeve 635 is in a closed position, the sleeve 635 decreases the effective footprint 614 of the collective flow orifice 616. When the sleeve 635 is in the maximally closed position, the sleeve 635 may not further obstruct or cover the flow orifice 668 of the housing 659 and the flow orifice 679 of the inner wall 639 of the chamber 651, and so the effective footprint 614 of the collective flow orifice 616 at that point is the smallest possible footprint allowed under the configuration of the ASRICV 650. As discussed above, in certain example embodiments, the ASRICV 650 may be configured so that the collective flow orifice 616 is never completely closed, regardless of the position of the sleeve 635 within the chamber 651, and so the effective footprint 614 of the collective flow orifice 616 is always greater than zero in this example. This allows for continuous pressure communication between the interior and exterior of the sub 690.

With no flow (Q) of the fluid 645 through the sub 690, $\Delta p=0$, resulting in the sleeve 635 of the ASRICV 650 being its full-open position. However, as Q increases, so does $\Delta p$. Depending on the configuration (e.g., the footprints) of the flow orifice 668, the flow orifice 679, and the flow orifice 636, there is a value of Q that generates a sufficiently large $\Delta p$ to cause the actuator 655 to operate and move the sleeve 635 (i.e., $\Delta x$ 682>0). At this point, the movement of the sleeve 635 starts to reduce the effective footprint 614 of the collective flow orifice 616, which acts to restrict further increases in Q. The rate that the effective footprint 614 of the collective flow orifice 616 changes with the position of the sleeve 635 depends on the overlapping profiles of the flow orifices cut out in the body of housing 659, the chamber 651, and the sleeve 635. Examples of this are shown in FIGS. 8A through 9B below.

Figure 8A:
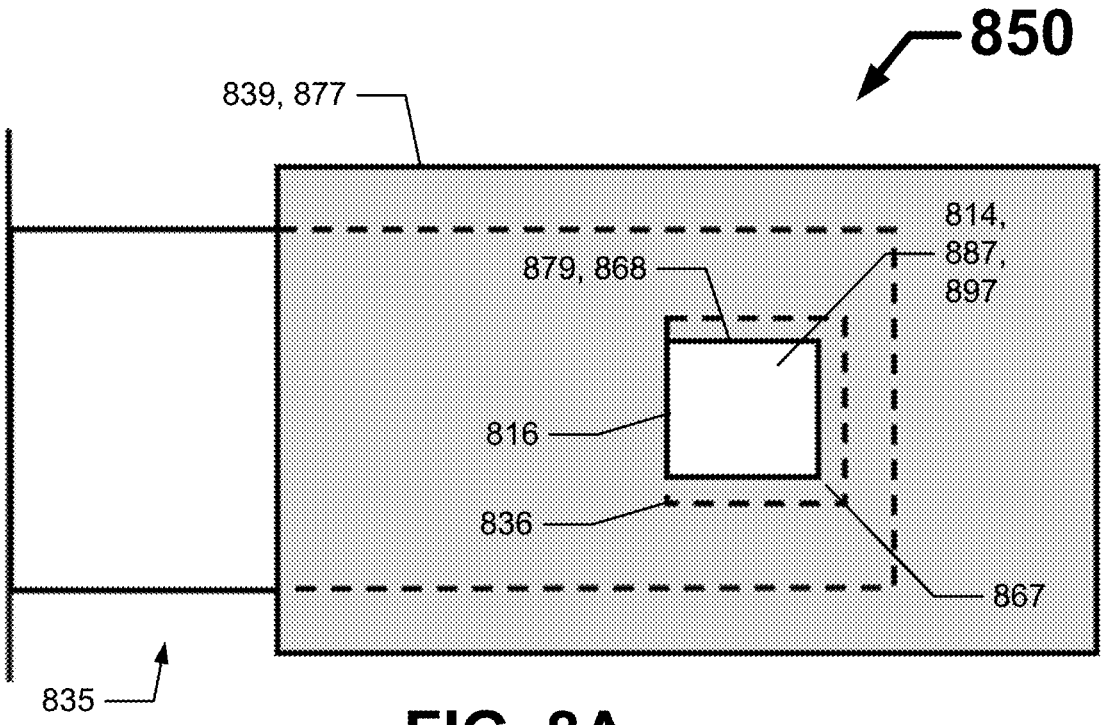
FIGS. 8A and 8B show how the effective footprint of the collective orifice changes linearly with movement of the sleeve of an ASRICV according to certain example embodiments.
Figure 8B:
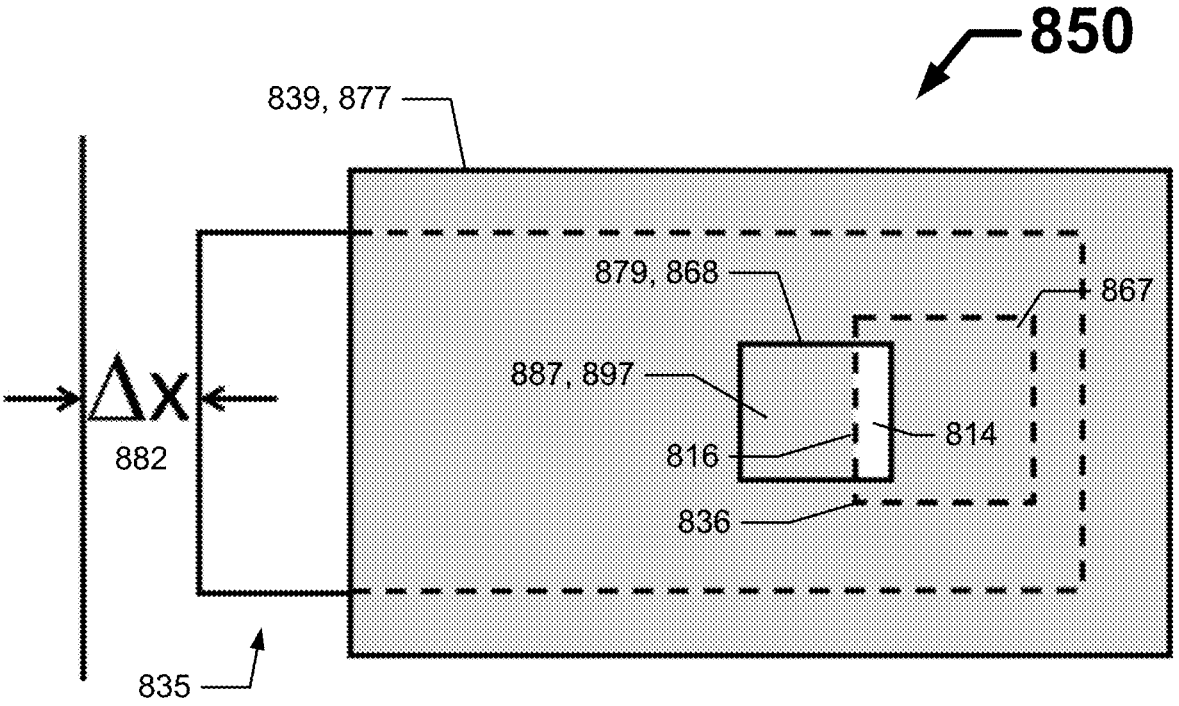

FIGS. 8A and 8B show how the effective footprint of the collective orifice changes linearly with movement of the sleeve 835 of an ASRICV 850 according to certain example embodiments. Referring to the description of FIGS. 1 through 7B above, the example ASRICV 850 of FIGS. 8A and 8B may be configured similarly to the ASRICV 650 of FIGS. 6 through 7B. The ASRICV 850 of FIGS. 8A and 8B includes the sleeve 835, a bottom wall 877 of the housing, and an inner wall 839 of the chamber. The bottom wall 877 has a flow orifice 868 and the inner wall 839 has a flow orifice 879 that are aligned with each other. Also, the footprint 897 of the flow orifice 868 is substantially the same as the footprint 887 of the flow orifice 879. In this example, the flow orifice 868 and the flow orifice 879 each have a cross-sectional square shape with substantially the same length and width.

The flow orifice 836 of the sleeve 835, shown in FIG. 8A in the open position and in the maximally closed position in FIG. 8B, has a footprint 867 that is the same cross-sectional shape (in this case, square) but slightly larger than the footprint 887 of the flow orifice 879 and the footprint 897 of the flow orifice 868. When the sleeve 835 is in the open position, the footprint 867 of the flow orifice 836 of the sleeve 835 completely encompasses the footprint 887 of the flow orifice 879 and the footprint 897 of the flow orifice 868. As a result, the effective footprint 814 of the collective flow orifice 816 is identical to the footprint 887 of the flow orifice 879 and the footprint 897 of the flow orifice 868.

When the sleeve 835 moves to the maximally closed position, as in FIG. 8B, moving a distance of $\Delta x$ 882, there is a relatively small overlap of the footprint 867 of the flow orifice 836, the footprint 887 of the flow orifice 879, and the footprint 897 of the flow orifice 868. As a result, the effective footprint 814 of the collective flow orifice 816 is smaller than the footprint 867 of the flow orifice 836, the footprint 887 of the flow orifice 879, or the footprint 897 of the flow orifice 868.

As the sleeve 835 moves between the open position and the maximally closed position, because of the square cross-sectional shape of the footprint 867 of the flow orifice 836, the footprint 887 of the flow orifice 879, or the footprint 897 of the flow orifice 868, the changes in the effective footprint 814 of the collective flow orifice 816 have a linear relationship. Put another way, there is a linear reduction of the effective footprint 814 of the collective flow orifice 816 as Δx 882 increases (i.e., as the sleeve 835 moves toward the maximally closed position). Conversely, there is a linear increase in the effective footprint 814 of the collective flow orifice 816 as Δx 882 decreases (i.e., as the sleeve 835 moves toward the open position).

Figure 9A:
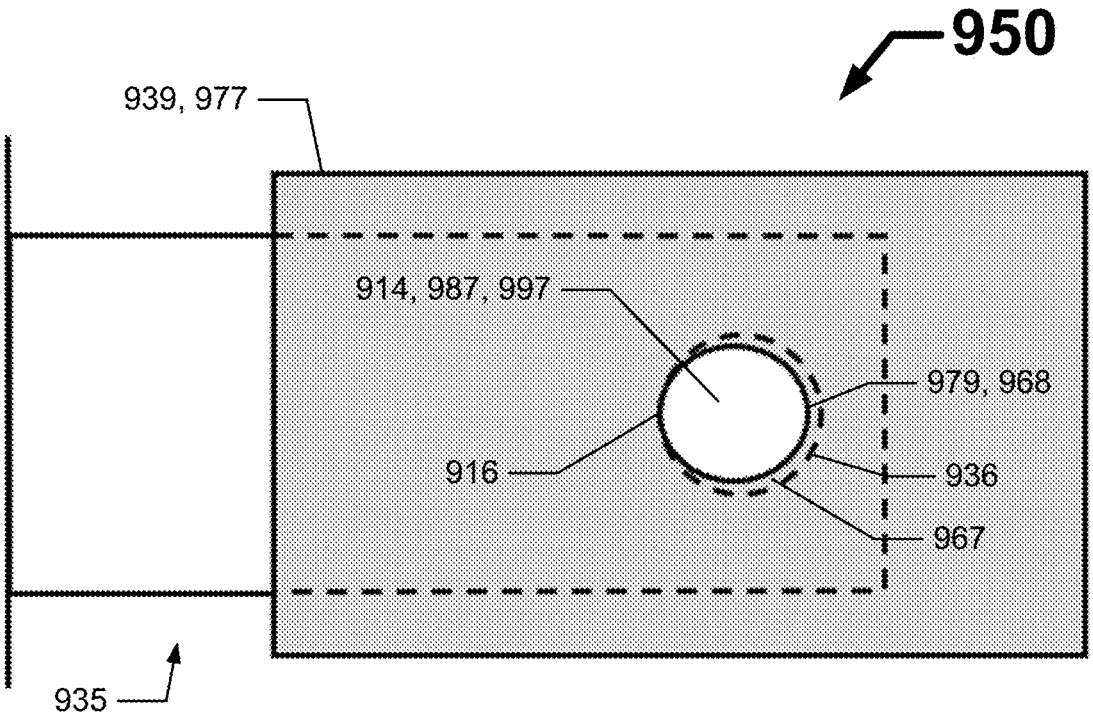
FIGS. 9A and 9B show how the effective footprint of the collective orifice changes non-linearly with movement of the sleeve of an ASRICV according to certain example embodiments.
Figure 9B:
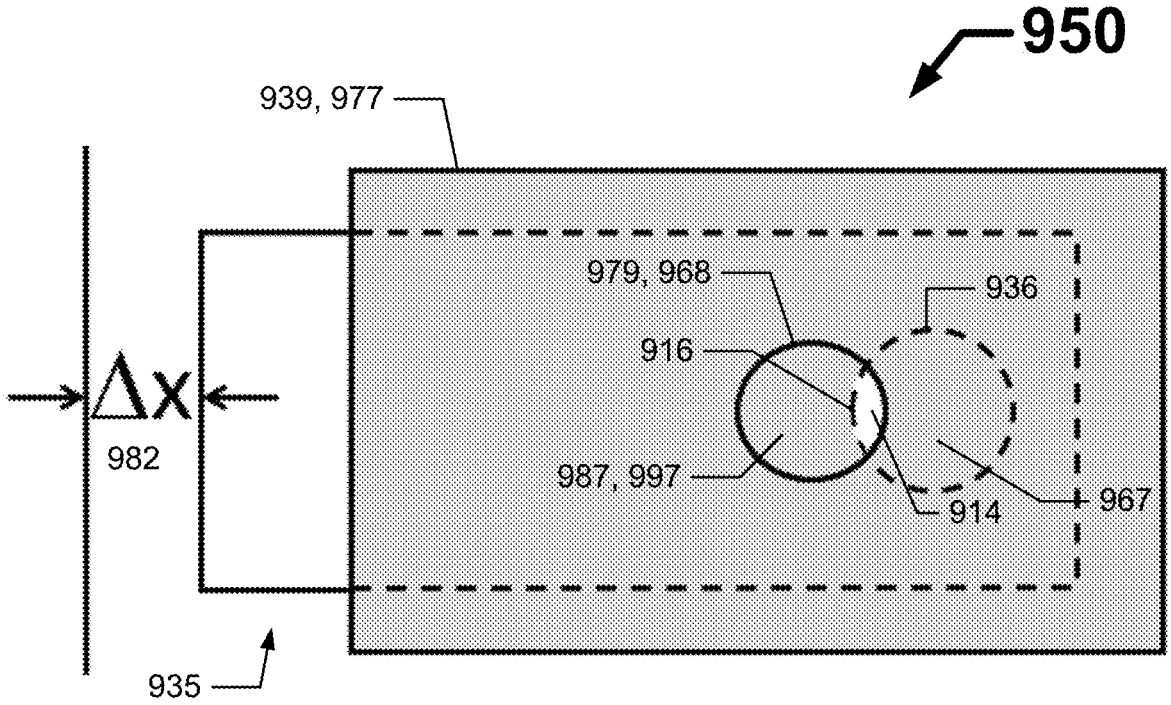

FIGS. 9A and 9B show how the effective footprint of the collective orifice changes non-linearly with movement of the sleeve 935 of an ASRICV 950 according to certain example embodiments. Referring to the description of FIGS. 1 through 8B above, the example ASRICV 950 of FIGS. 9A and 9B may be configured similarly to the ASRICV 650 of FIGS. 6 through 7B. The ASRICV 950 of FIGS. 9A and 9B includes the sleeve 935, a bottom wall 977 of the housing, and an inner wall 939 of the chamber. The bottom wall 977 has a flow orifice 968 and the inner wall 939 has a flow orifice 979 that are aligned with each other. Also, the footprint 997 of the flow orifice 968 is substantially the same as the footprint 987 of the flow orifice 979. In this case, the flow orifice 968 and the flow orifice 979 each have a cross-sectional circular shape with substantially the same diameter.

The flow orifice 936 of the sleeve 935, shown in FIG. 9A in the open position and in the maximally closed position in FIG. 9B, has a footprint 967 that is the same cross-sectional shape (in this case, circular) but slightly larger than the footprint 987 of the flow orifice 979 and the footprint 997 of the flow orifice 968. When the sleeve 935 is in the open position, the footprint 967 of the flow orifice 936 of the sleeve 935 completely encompasses the footprint 987 of the flow orifice 979 and the footprint 997 of the flow orifice 968. As a result, the effective footprint 914 of the collective flow orifice 916 is identical to the footprint 987 of the flow orifice 979 and the footprint 997 of the flow orifice 968.

When the sleeve 935 moves to the maximally closed position, as in FIG. 9B, moving a distance of Δx 982, there is a relatively small overlap of the footprint 967 of the flow orifice 936, the footprint 987 of the flow orifice 979, and the footprint 997 of the flow orifice 968. As a result, the effective footprint 914 of the collective flow orifice 916 is smaller than the footprint 967 of the flow orifice 936, the footprint 987 of the flow orifice 979, or the footprint 997 of the flow orifice 968.

As the sleeve 935 moves between the open position and the maximally closed position, because of the circular cross-sectional shape of the footprint 967 of the flow orifice 936, the footprint 987 of the flow orifice 979, or the footprint 997 of the flow orifice 968, the changes in the effective footprint 914 of the collective flow orifice 916 have a non-linear relationship. Put another way, there is a non-linear reduction of the effective footprint 914 of the collective flow orifice 916 as Δx 982 increases (i.e., as the sleeve 935 moves toward the maximally closed position). Conversely, there is a non-linear increase in the effective footprint 914 of the collective flow orifice 916 as Δx 982 decreases (i.e., as the sleeve 935 moves toward the open position).

FIGS. 8A through 9B show only 2 examples of how different cross-sectional shapes and/or sizes for each of the footprints involved in contributing to the effective footprint of the collective flow orifice may determine the operating window of an ASRICV of an example sub discussed herein. There are a significant number of combinations of overlapping cross-sectional shapes (e.g., circular, square, rectangular, oval, triangular, octagonal, hexagonal, random) and/or sizes may be used to modify the self-regulating behavior of an example ASRICV. These variables, combined with the effective footprint of the collective flow orifice when the sleeve is in the open position and the variable factors (e.g., a spring's preload force and compression stiffness) of the actuator, dictate the operating window of an example ASRICV.

Figure 10:
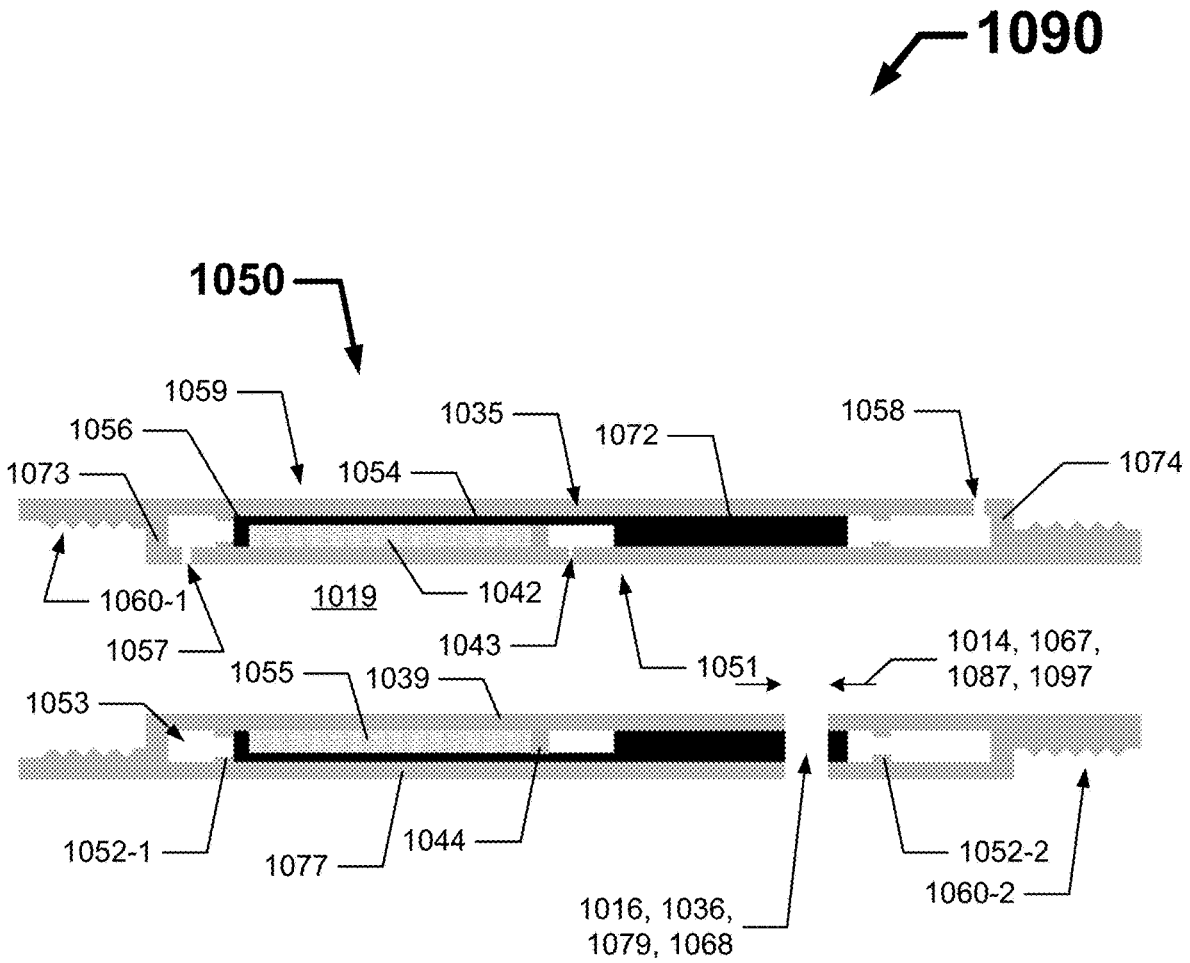
FIG. 10 shows a sectional side view of another sub that includes an ASRICV according to certain example embodiments.
Figure 11A:
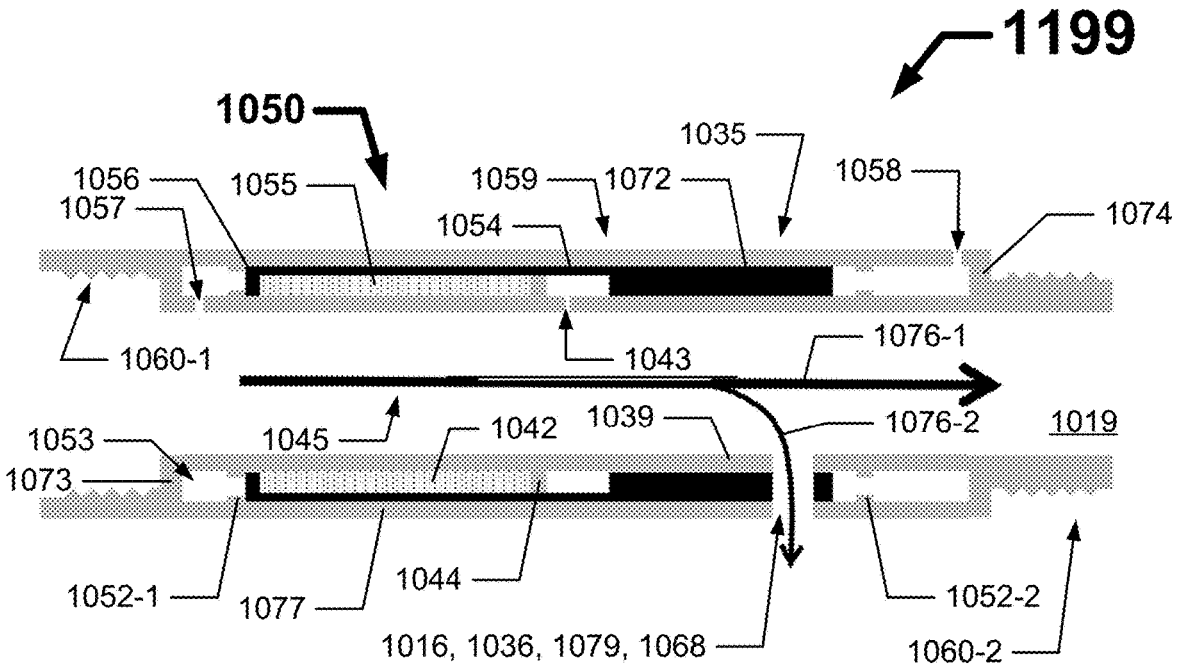
FIGS. 11A and 11B show part of still another field system that includes the sub of FIG. 10 that includes the ASRICV according to certain example embodiments.
Figure 11B:
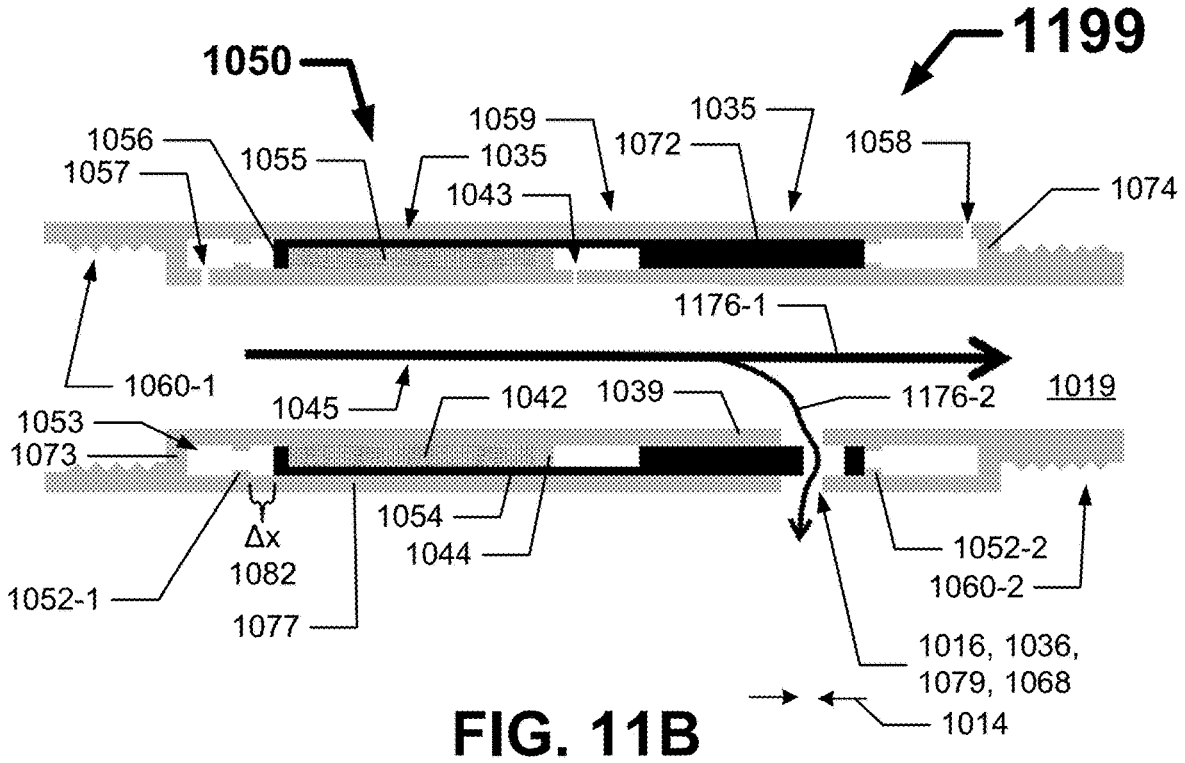

FIG. 10 shows a sectional side view of another sub 1090 that includes an ASRICV 1050 according to certain example embodiments. FIGS. 11A and 11B show part of still another field system 1199 that includes the sub 1090 of FIG. 10 that includes the ASRICV 1050 with the sleeve 1035 in the open position and a closed position, respectively, according to certain example embodiments. Referring to the description of FIGS. 1 through 9B above, the example sub 1090 of FIG. 10 includes a housing 1059 and an ASRICV 1050. The ASRICV 1050 in this case includes a chamber 1051, an actuator 1055, and a sleeve 1035, where the actuator 1055 and the sleeve 1035 are located within the chamber 1051.

The housing 1059 includes an outer wall 1077 that form a cavity 1019 that is open at both ends. The wall 1077 of the housing 1059 also a flow orifice 1068 that traverse therethrough at the bottom of the housing 1059. The flow orifice 1068 has a footprint 1097 (e.g., a width, a cross-sectional shape, a length) that is sufficient to allow for the flow of a fluid (as shown in FIGS. 11A and 11B below) therethrough. The housing 1059 in this case is cylindrical in shape and has a size (e.g., inner diameter, outer diameter) to allow the sub 1090 (and so also the ASRICV 1050) to be substantially seamlessly incorporated into a tubing string (e.g., tubing string 311) used in a field operation within a wellbore (e.g., wellbore 320).

In addition, the housing 1059 of the sub 1090 in this example includes one coupling feature 1060-1 in the form of mating threads located at one end (e.g., the left or upstream end) of the housing 1059, as well as another coupling feature 1060-2 in the form of mating threads located at the opposite end of the housing 1059. These coupling features 1060 allow the sub 1090 to be coupled to two other components of a tubing string. The housing 1059 may be made of one or more of any of a number of materials (e.g., steel) that are designed to withstand the conditions (e.g., temperature, pressure, flow rate) that exist in a wellbore during a field operation.

The chamber 1051 of the ASRICV 1050 includes an inner wall 1039, a proximal wall 1073, and a distal wall 1074 that form a cavity 1053. The wall 1077 of the housing 1059 also serves as the outer wall of the chamber 1051. In this case, the cavity 1053 of the chamber 1051 is smaller than the cavity 1019 of the housing 1059. Also, in this case, aside from the internal pressure port 1057 (discussed below), the cavity 1053 of the chamber 1051 is isolated from (i.e., has no overlap with) the cavity 1019 of the housing 1059. The actuator 1055 and the sleeve 1035 are disposed in the cavity 1053 of the chamber 1051 in this case. The sleeve 1035 is configured to move within part of the cavity of the chamber 1051 when the actuator 1055 operates.

The inner wall 1039 of the chamber 1051 has a flow orifice 1079 that traverses the thickness of the wall 1039. The flow orifice 1079 in the inner wall 1039 of the chamber 1051 in this example is coincident (e.g., vertically aligned) with the flow orifice 1068 in the wall 1077 of the housing 1059 of the sub 1090. The flow orifice 1079 has a footprint 1087 (e.g., a width, a cross-sectional shape, a length) that is substantially the same as the footprint 1097 of the flow orifice 1068 in the wall 1077 of the housing 1059. In alternative embodiments, the footprint 1087 of the flow orifice 1079 may differ from one or more characteristics of the footprint 1097 of the flow orifice 1068.

The actuator 1055 of the ASRICV 1050 is configured to move the sleeve 1035 within the chamber 1051 based a differential in pressure between the cavity 1019 ($p_i$) of the sub 1090 and outside ($p_o$) the sub 1090. The actuator 1055 in this case includes a gas that is captured within part of the chamber 1051. In this way, the actuator 1055 is or includes a bellows. The actuator 1055 operates without any external controller and/or without any electrical components. Specifically, in this case, the actuator 1055 is positioned within a space 1042 of the cavity 1053 of the chamber 1051 defined by the inner wall 1039 of the chamber 1051, an internal side wall 1044 that extends laterally outward from the inner wall 1039 of the housing 1059 and is positioned upstream from the proximal end of the distal wall 1072 of the sleeve 1035, part of an inner wall 1054 of the sleeve 1035, and a proximal wall 1056 of the sleeve 1035.

The space 1042 in which the actuator 1055 is positioned may be filled with any type of gas (e.g., nitrogen, helium, xenon) to ensure reliable operation of the actuator 1055 over time. The inner wall 1039 of the chamber 1051 may include one or more motion dampening orifices 1043 that traverse therethrough. In this case, there is a single motion dampening orifice 1043 located in the inner wall 1039 between the internal side wall 1044 and the proximal end of the distal wall 1072 of the sleeve 1035. Each motion dampening orifice 1043 may be configured (e.g., have a width, have a cross-sectional shape) in such a way as to ensure reliable operation of the actuator 1055 over time. If there are multiple motion dampening orifices 1043, the configuration of one motion dampening orifice 1043 may be the same as, or different than, the configuration of one or more of the other motion dampening orifices 1043. The size of the space 1042 in this example does not remain constant as the sleeve 1035 moves within the chamber 1051.

The actuator 1055 in this example is configured, when operated, to move the sleeve 1035 forward and/or backward within the chamber 1051. In this case, the distal wall 1072 of the sleeve 1035 has a flow orifice 1036 that traverses the thickness of the distal wall 1072. When the sleeve 1035 is in the open position, the flow orifice 1036 of the sleeve 1035 is coincident (e.g., vertically aligned) with the flow orifice 1068 in the wall 1077 of the housing 1059 of the sub 1090 and with the flow orifice 1079 that traverses the thickness of the wall 1039 of the chamber 1051. The flow orifice 1036 of the sleeve 1035 in this example has a footprint 1067 (e.g., a width, a cross-sectional shape, a length) that is substantially the same as the footprint 1097 of the flow orifice 1068 in the wall 1077 of the housing 1059 and as the footprint 1087 of the flow orifice 1079 of the inner wall 1039 of the chamber 1051. In alternative embodiments, the footprint 1067 of the flow orifice 1036 may differ from one or more characteristics of the footprint 1097 of the flow orifice 1068 and/or of the footprint 1087 of the flow orifice 1079.

If the sleeve 1035 is freely rotatable within the chamber 1051, the flow orifice 1036 may extend around some or all of the sleeve 1035. For example, in such case, the flow orifice 1036 may include a series of rectangular openings (when viewed from above) where adjacent openings have a thin portion of the distal wall 1072 of the sleeve 1035 positioned therebetween. In alternative embodiments, the sleeve 1035 and/or one or more portions (e.g., the inner wall 1039, the proximal wall 1073) of the chamber 1051 may include one or more of a number of features (e.g., protrusions, recesses, detents, slots, tabs) that prevent the sleeve 1035 from rotating within the chamber 1051. In this way, the distal wall 1072 of the sleeve 1035 may have a flow orifice 1036 in the form of a single opening that traverses the thickness of the distal wall 1072.

In any case, the characteristics (e.g., cross-sectional shape, length, width) of the footprint 1067 of the flow orifice 1036 of the sleeve 1035 may be substantially similar to the corresponding characteristics of the footprint 1087 of the flow orifice 1079 of the inner wall 1039 of the chamber 1051 and/or the corresponding characteristics of the footprint 1097 of the flow orifice 1068 in the wall 1077 of the housing 1059. In this way, when the sleeve 1035 is in the fully open position, the characteristics of the effective footprint 1014 of the collective flow orifice 1016 is substantially the same as the corresponding characteristics of the footprint 1067 of the flow orifice 1036, the footprint 1087 of the flow orifice 1079, and the footprint 1097 of the flow orifice 1068.

The overlap of the flow orifice 1079 of the inner wall 1039 of the chamber 1051, the flow orifice 1036 of the sleeve 1035, and the flow orifice 1068 in the wall 1077 of the housing 1059 results in a collective orifice 1016 having an effective footprint 1014. As a result, when the sleeve 1035 is in the open position, the effective footprint 1014 of the collective orifice 1016 is substantially the same as the footprint 1067 of the flow orifice 1036 of the sleeve 1035, the footprint 1097 of the flow orifice 1068 in the wall 1077 of the housing 1059, and the footprint 1087 of the flow orifice 1079 of the inner wall 1039 of the chamber 1051. As shown in FIG. 11A, in such cases when the sleeve 1035 is in the open position, a maximum portion 1076-2 of a fluid 1045 flowing through the cavity 1019 of the housing 1059 is diverted through the collective orifice 1016 to a subterranean formation while a remaining portion 1076-1 of the fluid 1045 continues to flow out the opposite end of the housing 1059.

As the actuator 1055 operates to move the sleeve 1035 to a closed position from the open position, as shown in FIG. 11B, the flow orifice 1036 of the sleeve 1035 is no longer coincident (e.g., is no longer vertically aligned) with the flow orifice 1068 in the wall 1077 of the housing 1059 of the sub 1090 and with the flow orifice 1079 that traverses the thickness of the wall 1039 of the chamber 1051. As a result, the effective footprint 1014 of the collective orifice 1016 is reduced, which results in a lesser portion 1176-2 (where the amount of the portion 1176-2 is less than the portion 1076-2 of FIG. 11A) of the fluid 1045 flowing through the cavity 1019 of the housing 1059 is diverted through the collective orifice 1016 to the subterranean formation while a remaining portion 1176-1 (where the amount of the portion 1176-1 is greater than the amount of the portion 1076-1) of the fluid 1045 continues to flow out the opposite end of the housing 1059.

As discussed above, the actuator 1055 operates when the difference between the internal pressure (p) (in this case, the pressure within the cavity 1019) and the external pressure ($p_o$) [i.e., $\Delta p$] exceeds a minimum threshold value. When the actuator 1055 operates, the sleeve 1035 moves to control the effective footprint 1014 of the collective flow orifice 1016 and, ultimately, the flowrate at which a portion (e.g., 1076-2, 1176-2) of the fluid 1045 exits the sub 1090. In this example, the resultant forces from $\Delta p$ act axially on the sleeve 1035. The various characteristics of the actuator 1055 (specifically, the gas) in this case may be selected by a user so that the actuator 1055 operates in the manner desired. For example, the preload force imposed by the pressure and/or volume of the gas of the actuator 1055 may be used to control the point at which $\Delta p$ is sufficiently large to operate the actuator 1055 and move the sleeve 1035. The pressure and/or volume of the gas of the actuator 1055 may additionally or alternatively be used to control the rate at which the sleeve 1035 moves with changes in $\Delta p$.

The ASRICV 1050 in this case is configured to operate autonomously based on the Δp that the actuator 1055 of the ASRICV 1050 experiences locally. As a result, by moving the sleeve 1035 in a controlled fashion, the actuator 1055 (and so the ASRICV 1050 in general) self-regulates fluid flow in response to changes in Δp. FIGS. 11A and 11B illustrate the sleeve 1035 in its fully-open (Δx 1082=0) and maximally-closed (Δx 1082=max) positions, respectively, where Δx 1082 represents the position of the sleeve 1035 relative to the fully open position. In order for the actuator 1055 to experience the pressure differential, the ASRICV 1050 may include one or more of a number of features. For example, in this case, the ASRICV 1050 includes an internal pressure port 1057 (corresponding to $p_i$) and an external pressure port 1058 (corresponding to $p_o$). In alternative embodiments, the ASRICV 1050 may include multiple internal pressure ports 1057 and/or multiple external pressure ports 1058.

The internal pressure port 1057 is located in this example in the inner wall 1039 of the chamber 1051 adjacent to the proximal wall 1073 of the chamber 1051 and upstream of the proximal wall 1056 of the sleeve 1035. In this case, the internal pressure port 1057 is a relatively small circular hole that traverses the thickness of the inner wall 1039 of the chamber 1051. The external pressure port 1058 is located in this example in the outer wall 1077 of the housing 1059 adjacent to the distal wall 1074 of the chamber 1051 and downstream of the distal wall 1072 of the sleeve 1035. In this case, the external pressure port 1058 is a relatively small circular hole that traverses the thickness of the outer wall 1077 of the housing 1059.

When the pressure ($p_i$) at the internal pressure port 1057 exceeds the pressure ($p_o$) at the external pressure port 1058, the differential pressure ($\Delta p = p_i - p_o$) acting against opposite ends (i.e., the proximal wall 1056 and the distal wall 1072) of the sleeve 1035 applies a net force directed downstream. Initially, when the differential between the pressure ($p_i$) and the pressure ($p_o$) is relatively low, the compressive force of the gas of the actuator 1055 applied to the proximal wall 1056 of the sleeve 1035 exceeds the net downstream force imposed by Δp acting against opposite ends (i.e., the proximal wall 1056 and the distal wall 1072) of the sleeve 1035. As a result, the sleeve 1035 remains stationary.

When the pressure ($p_i$) at the internal pressure port 1057 exceeds the pressure ($p_o$) at the external pressure port 1058 by a certain amount (e.g., the minimum threshold pressure amount), then the net downstream force imposed by Δp acting against opposite ends (i.e., the proximal wall 1056 and the distal wall 1072) of the sleeve 1035 exceeds the upstream force of the gas of the actuator 1055 applied to the proximal wall 1056 of the sleeve 1035. As a result, the sleeve 1035 moves downstream. The amount of downstream movement of the sleeve 1035 (in other words, the extent to which the sleeve 1035 is in a closed position) depends on the extent to which the internal pressure ($p_i$) exceeds the external pressure ($p_o$). In some cases, the motion dampening orifice 1043 may also serve as a type of internal pressure port, where the part of the cavity 1053 of the chamber 1051 located between the internal side wall 1044 and the proximal end of the distal wall 1072 of the sleeve 1035 receives the internal pressure ($p_i$) through the motion dampening orifice 1043.

When the differential between the internal pressure ($p_i$) and the external pressure ($p_o$) decreases, the upstream force applied by the gas of the actuator 1055 may overcome the net downstream force imposed by Δp acting against opposite ends (i.e., the proximal wall 1056 and the distal wall 1072) of the sleeve 1035, causing the sleeve 1035 to return to the open position within the chamber 1051. Since the gas of the actuator 1055 is reacting in real time to the pressure differential experienced by the sub 1090, the position of the sleeve 1035 is being adjusted in real time by the actuator 1055. When the pressure differential is sufficiently high, the position of the sleeve 1035 reduces the amount of the portion 1176-2 of the fluid 1045 that flows through the collective orifice 1016 out of the sub 1090 by reducing the effective footprint 1014 of the collective orifice 1016. Conversely, when the pressure differential is relatively minimal, the position of the sleeve 1035 is such that the sleeve 1035 has little to no impact on the effective footprint 1014 of the collective orifice 1016, and so the effective footprint 1014 is substantially the same as the footprint 1067 of the flow orifice 1036 of the sleeve 1035. As a result, the amount of the portion 1076-2 of the fluid 1045 that flows through the collective orifice 1016 out of the sub 1090 is at a maximum.

In order to limit the range of the motion of the sleeve 1035 by the actuator 1055, the ASRICV 1050 may include one or more stops 1052. In this case, the ASRICV 1050 has two stops 1052. Stop 1052-1 in this case is in the form of a pair of protrusions, where one protrusion of the stop 1052-1 extends toward the cavity 1053 of the chamber 1051 from the outer wall 1077 of the housing 1059 around some or all of the perimeter of the chamber 1051, and where the other protrusion of the stop 1052-1 extends toward the cavity 1053 of the chamber 1051 from the inner wall 1039 of the chamber 1051 around some or all of the perimeter of the chamber 1051. The stop 1052-1 in this case is positioned slightly downstream of the internal pressure port 1057 within the cavity 1053 of the chamber 1051.

The distance between the protrusions of the stop 1052-1 may be less than the thickness of the proximal wall 1056 of the sleeve 1035. In this way, the stop 1052-1 prevents the sleeve 1035 from traveling further upstream within the cavity 1053 of the chamber 1051. The position of the stop 1052-1 within the cavity 1053 of the chamber 1051 in this case means that, when the proximal wall 1056 of the sleeve 1035 abuts against the stop 1052-1, the flow orifice 1036 that traverses the thickness of the distal wall 1072 of the sleeve 1035 is substantially aligned with (coincident with) the flow orifice 1079 and the flow orifice 1068. Also, the distance between the protrusions of the stop 1052-1 may be large enough to allow the internal pressure ($p_i$) that enters the cavity 1053 of the chamber 1051 through the internal pressure port 1057 to be communicated downstream of the stop 1052-1 to the proximal wall 1056 of the sleeve 1035.

Stop 1052-2 in this case is also in the form of a pair of protrusions, where one protrusion of the stop 1052-2 extends toward the cavity 1053 of the chamber 1051 from the outer wall 1077 of the housing 1059 around some or all of the perimeter of the chamber 1051, and where the other protrusion of the stop 1052-2 extends toward the cavity 1053 of the chamber 1051 from the inner wall 1039 of the chamber 1051 around some or all of the perimeter of the chamber 1051. The stop 1052-2 in this case is positioned slightly upstream of the external pressure port 1058 within the cavity 1053 of the chamber 1051.

The distance between the protrusions of the stop 1052-2 may be less than the thickness of the distal wall 1072 of the sleeve 1035. In this way, the stop 1052-2 prevents the sleeve 1035 from traveling further downstream within the cavity 1053 of the chamber 1051. The position of the stop 1052-2 within the cavity 1053 of the chamber 1051 in this case means that, when the distal wall 1072 of the sleeve 1035 abuts against the stop 1052-2, the flow orifice 1036 that traverses the thickness of the distal wall 1072 of the sleeve 1035 does not completely overlap or cover the flow orifice 1079 and the flow orifice 1068. In this way, when the sleeve is in the maximally closed position, the effective footprint 1014 of the collective orifice 1016 is greater than zero. Also, the distance between the protrusions of the stop 1052-2 may be large enough to allow the external pressure ($p_o$) that enters the distal end of the cavity 1053 of the chamber 1051 through the external pressure port 1058 to be communicated upstream of the stop 1052-2 to the distal wall 1072 of the sleeve 1035.

As discussed above, the distal wall 1072 of the sleeve 1035 of the ASRICV 1050 is configured to move within the chamber 1051 to partially obstruct the flow orifice 1068 of the housing 1059 and the flow orifice 1079 in the inner wall 1039 of the chamber 1051 when a minimum pressure differential occurs relative to the sub 1090. When the sleeve 1035 does not substantially obstruct the flow orifice 1068 of the housing 1059 and the flow orifice 1079 in the inner wall 1039 of the chamber 1051, the sleeve 1035 is in the open position. When the sleeve 1035 is in the open position, the effective footprint 1014 of the collective flow orifice 1016 is substantially the same as the corresponding characteristics of the footprint 1067 of the flow orifice 1036, the footprint 1087 of the flow orifice 1079, and the footprint 1097 of the flow orifice 1068.

When the sleeve 1035 partially obstructs the flow orifice 1068 of the housing 1059 and the flow orifice 1079 of the inner wall 1039 of the chamber 1051, the sleeve 1035 is in a closed position. In certain example embodiments, the sleeve 1035 may have number of closed positions, where each closed position is based on the extent to which the flow orifice 1068 of the housing 1059 and the flow orifice 1079 of the inner wall 1039 of the chamber 1051 is obstructed by the sleeve 1035, which in turn is based on the amount of differential pressure relative to the sub 1090.

When the sleeve 1035 is in a closed position, the sleeve 1035 decreases the effective footprint 1014 of the collective flow orifice 1016. When the sleeve 1035 is in the maximally closed position, the sleeve 1035 may not further obstruct or cover the flow orifice 1068 of the housing 1059 and the flow orifice 1079 of the inner wall 1039 of the chamber 1051, and so the effective footprint 1014 of the collective flow orifice 1016 at that point is the smallest possible footprint allowed under the configuration of the ASRICV 1050. As discussed above, in certain example embodiments, the ASRICV 1050 may be configured so that the collective flow orifice 1016 is never completely closed, regardless of the position of the sleeve 1035 within the chamber 1051, and so the effective footprint 1014 of the collective flow orifice 1016 is always greater than zero in this example. This allows for continuous pressure communication between the interior and exterior of the sub 1090.

With no flow (Q) of the fluid 1045 through the sub 1090, $\Delta p=0$, resulting in the sleeve 1035 of the ASRICV 1050 being its full-open position. However, as Q increases, so does $\Delta p$. Depending on the configuration (e.g., the footprints) of the flow orifice 1068, the flow orifice 1079, and the flow orifice 1036, there is a value of Q that generates a sufficiently large $\Delta p$ to cause the actuator 1055 to operate and move the sleeve 1035 (i.e., $\Delta x$ 1082>0). At this point, the movement of the sleeve 1035 starts to reduce the effective footprint 1014 of the collective flow orifice 1016, which acts to restrict further increases in Q. The rate that the effective footprint 1014 of the collective flow orifice 1016 changes with the position of the sleeve 1035 depends on the overlapping profiles of the flow orifices cut out in the body of housing 1059, the chamber 1051, and the sleeve 1035.

Figure 12A:
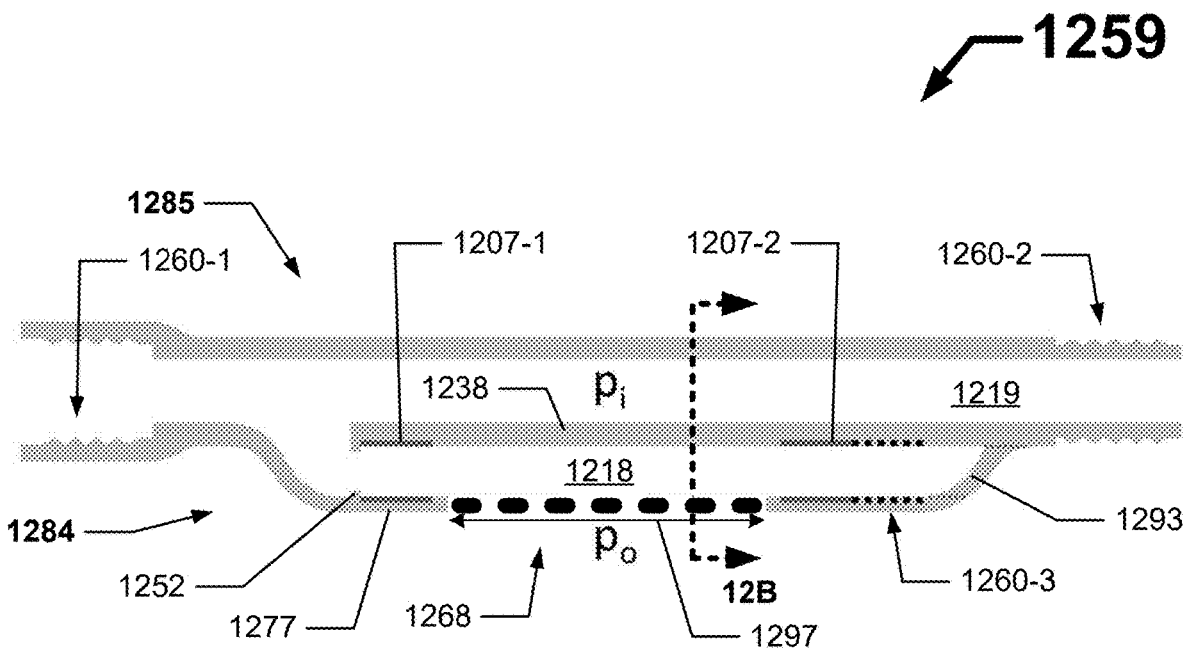
FIGS. 12A and 12B show a housing of a sub in the form of a side pocket carrying mandrel that may be used to host an example ASRICV according to certain example embodiments.
Figure 12B:
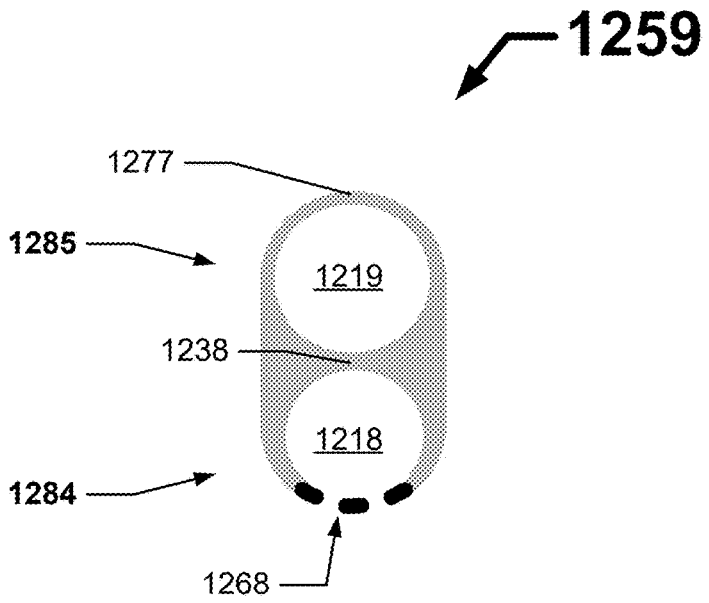

FIGS. 12A and 12B show a sectional side view and a sectional front view, respectively, of a housing 1259 of a sub in the form of a side pocket carrying mandrel that may be used to host an example ASRICV according to certain example embodiments. Referring to the description of FIGS. 1 through 11B, the housing 1259 of FIGS. 12A and 12B includes one or more outer walls 1277 that form a main bore 1285 having a cavity 1219 that is open at both ends. The walls 1277 of the housing 1259 also form a side pocket 1284 having a secondary cavity 1218. The secondary cavity 1218 of the side pocket 1284 branches off from the cavity 1219 of the main bore 1285 in a downward direction, becomes parallel with the cavity 1219, and has a distal end that is closed with a removable cap 1293. When the removable cap 1293 is removed, the resulting opening may be large enough to insert an ASRICV into and/or remove an ASRICV from the cavity 1218 of the side pocket 1284. When the removable cap 1293 is coupled to the rest of the housing 1259, an environmental seal may be created.

The wall 1277 of the housing 1259 at the bottom of the side pocket 1284 has a flow orifice 1268 that traverses therethrough. The flow orifice 1268 has a footprint 1297 (e.g., a width, a cross-sectional shape, a length) that is sufficient to allow for the flow of a fluid (as shown in FIGS. 13A through 13D below) therethrough. The main bore 1285 and the side pocket 1284 of the housing 1259 in this case is each cylindrical in shape, and the main bore 1285 has a size (e.g., inner diameter, outer diameter) to allow the sub housing 1259 of the sub to be substantially seamlessly incorporated into a tubing string (e.g., tubing string 311) used in a field operation within a wellbore (e.g., wellbore 320). Also, the side pocket 1284 is configured to be large enough to receive an ASRICV.

In addition, the housing 1259 in this example includes one coupling feature 1260-1 in the form of mating threads located at one end (e.g., the left or upstream end) of the main bore 1285 of the housing 1259, as well as another coupling feature 1260-2 in the form of mating threads located at the opposite end of the main bore 1285 of the housing 1259. These coupling features 1260 allow the housing 1259 to be coupled to two other components of a tubing string. The housing 1259 may be made of one or more of any of a number of materials (e.g., steel) that are designed to withstand the conditions (e.g., temperature, pressure, flow rate) that exist in a wellbore during a field operation.

As shown in FIG. 12B, the cross-sectional shape of the cavity 1219 of the main bore 1285 and the cavity 1218 of the side pocket 1284 is circular, where the size of the cross-section of the cavity 1219 is slightly larger than the cross-section of the cavity 1218. In alternative embodiments, the cross-sectional shape of the cavity 1219 of the main bore 1285 and/or the cavity 1218 of the side pocket 1284 may have any of a number of other shapes. Further, the size of the cross-section of the cavity 1219 and size of the cross-section of the cavity 1218 may be different relative to each other and/or different relative to what is shown in FIG. 12B.

In certain example embodiments, the side pocket 1284 may include one or more features for accommodating an ASRICV. For example, in this case, there are two sealing surfaces 1207 disposed along the inner surface of the wall 1277 that provide a pressure seal (via gaskets or O-rings—like the sealing O-ring 1308 in FIG. 13B below) when an ASRICV (e.g., ASRICV 1350 in FIGS. 13B and 13D below) is inserted in the side pocket 1284. Sealing surface 1207-1 is located at the proximal end of the side pocket 1284, upstream of the flow orifice 1268. Sealing surface 1207-2 is located toward the distal end of the side pocket 1284, downstream of the flow orifice 1268.

As another example, in this case, there is a coupling feature 1260-3 in the form of mating threads disposed along the inner surface of the wall 1277 that forms the side pocket 1284 adjacent to and downstream of the sealing surface 1207-2. The coupling feature 1260-3 may be configured to receive a retention cap 1388, as discussed below with respect to FIGS. 13A and 13B. As yet another example, in this case, the side pocket 1284 may include a stop 1252 that is substantially similar to the stops 652 discussed above. For example, the stop 1252 may be in the form of one or more protrusions that extend toward the cavity 1218 of the side pocket 1284 from the outer wall 1277 and/or from the inner wall 1238 around some or all of the inner perimeter of the side pocket 1284. The stop 1252 in this case is positioned adjacent to and upstream of the sealing surface 1207-1 and is configured to retain the side wall 1339 of the chamber 1351 (discussed below) of an ASRICV within the cavity 1218 of the side pocket 1284.

Figure 13A:
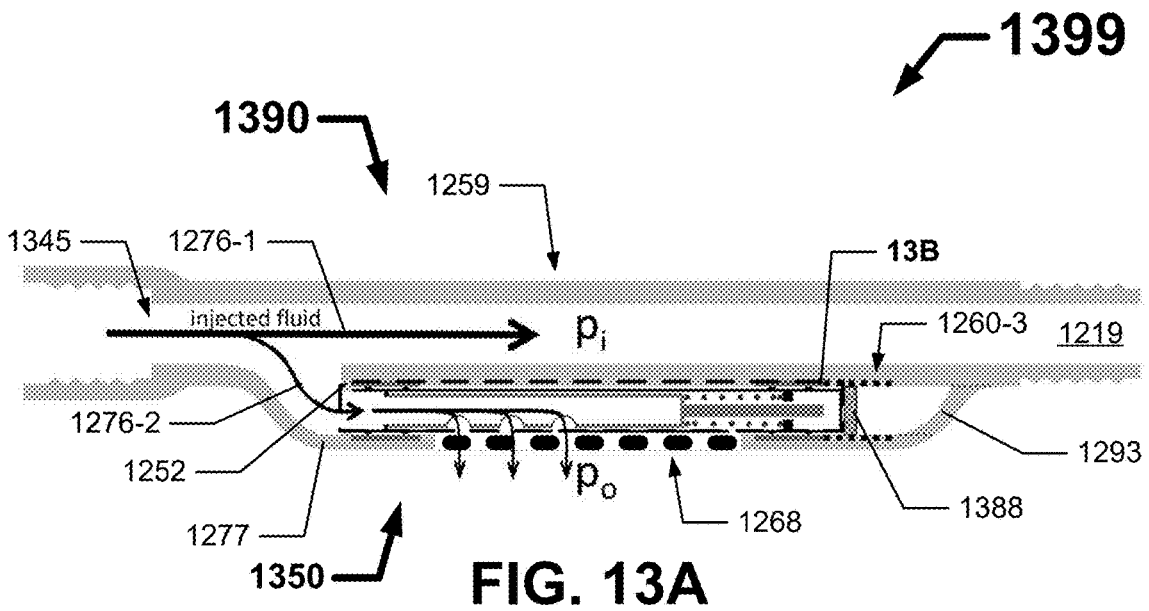
FIGS. 13A through 13D show part of yet another field system that includes the housing of the sub of FIGS. 12A and 12B with an example ASRICV according to certain example embodiments.
Figure 13B:
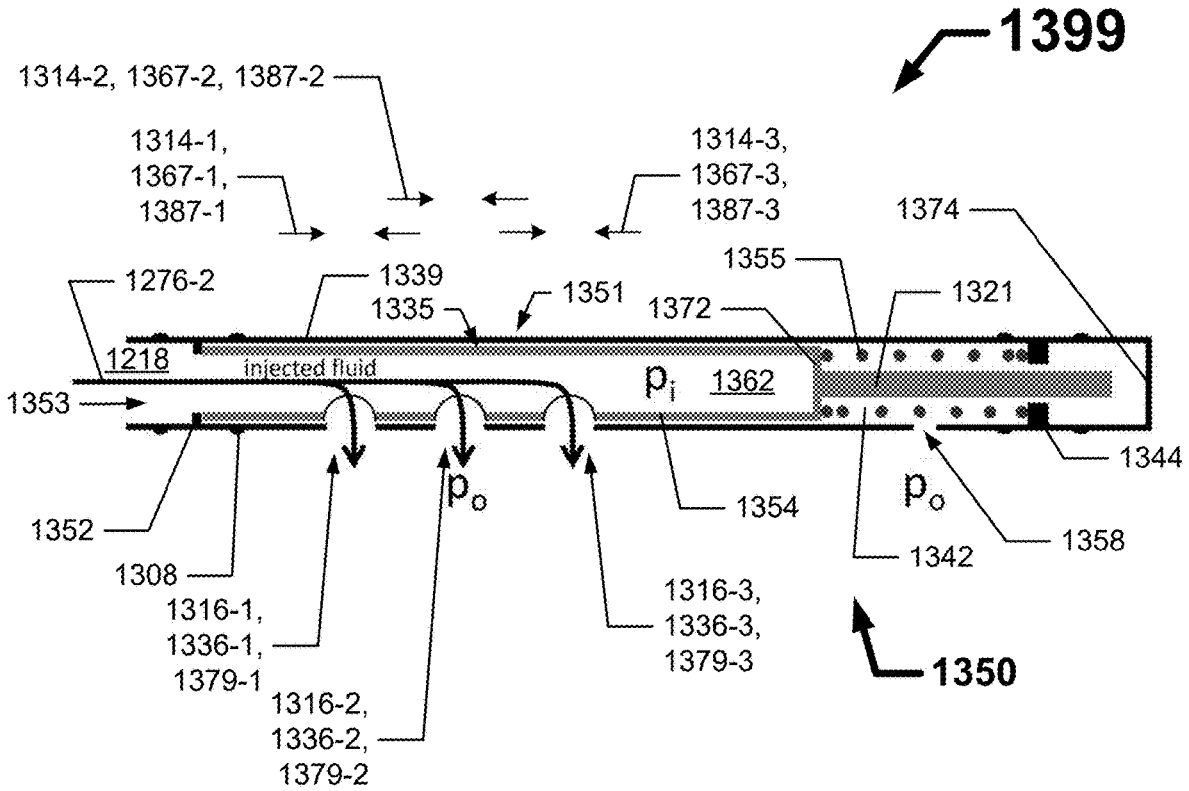
Figure 13C:
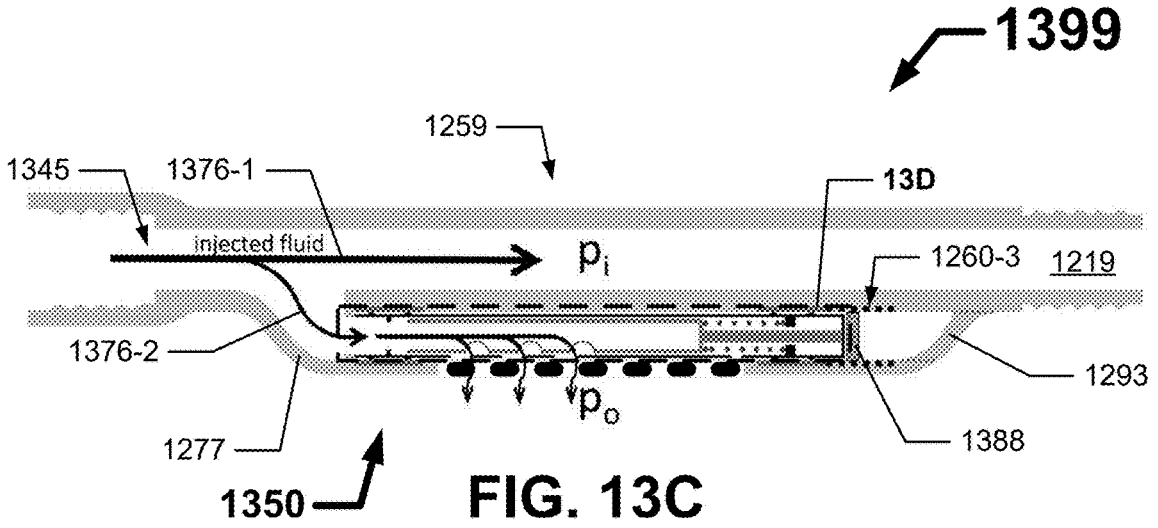
Figure 13D:
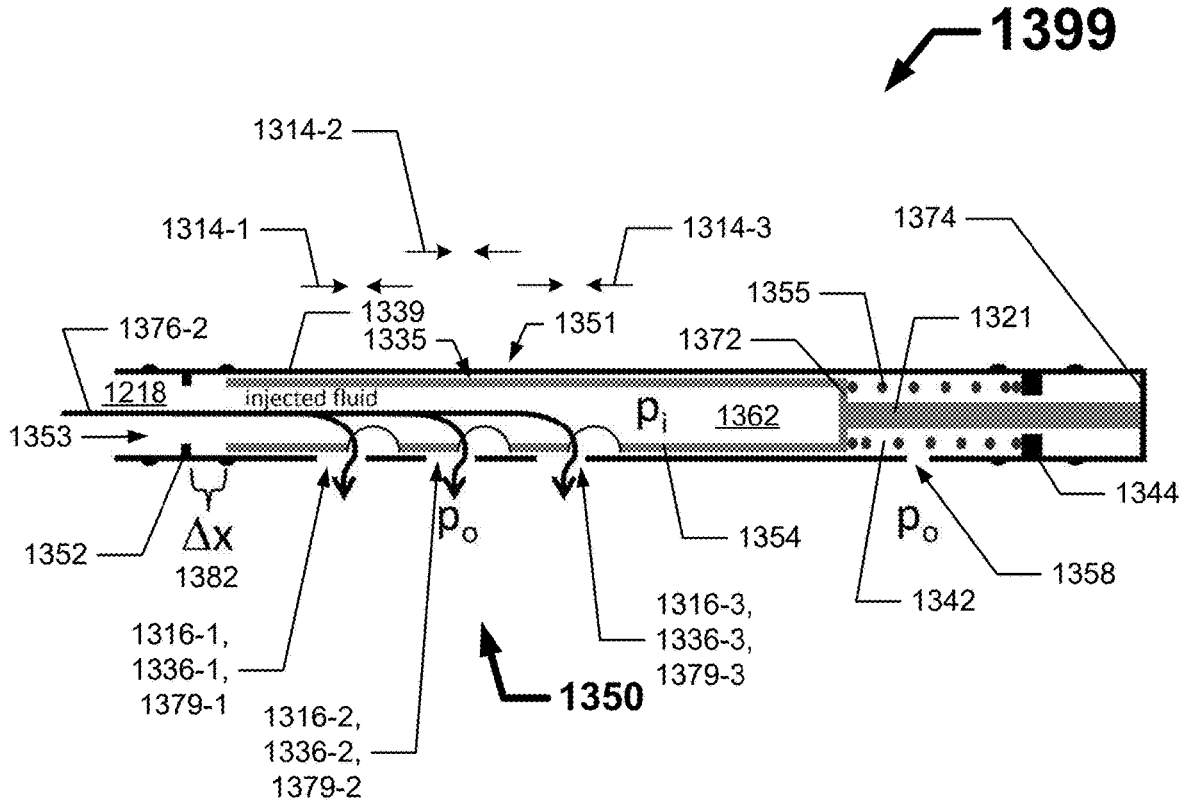

FIGS. 13A through 13D show part of yet another field system 1399 that includes the housing 1259 of the sub of FIGS. 12A and 12B with an example ASRICV 1350 according to certain example embodiments. Specifically, FIG. 13A shows a sectional side view of the field system 1399 with the ASRICV 1350 in the open position, and FIG. 13B shows a detailed view of part of the field system 1399 of FIG. 13A. FIG. 13C shows a sectional side view of the field system 1399 with the ASRICV 1350 in a closed position, and FIG. 13D shows a detailed view of part of the field system 1399 of FIG. 13C.

Referring to the description of FIGS. 1 through 12B, the field system 1399 of FIGS. 13A through 13D includes a sub 1390 having an ASRICV 1350 inserted into the cavity 1218 of the side pocket 1284 of the housing 1259. The chamber 1351 of the ASRICV 1350 is cylindrical in shape (to match the shape of the cavity 1218 of the side pocket 1284) with a side wall 1339 and a distal wall 1374 that form a cavity 1353. In this case, the cavity 1353 of the chamber 1351 is smaller than the cavity 1218 of the side pocket 1284 of the housing 1259. Also, in this case, the cavity 1353 of the chamber 1351 is open-ended at its proximal (upstream) end. The actuator 1355 and the sleeve 1335 are disposed in the cavity 1353 of the chamber 1351 in this case. The sleeve 1335 is configured to move within part of the cavity 1353 of the chamber 1351 when the actuator 1355 operates.

The side wall 1339 of the chamber 1351 has three flow orifices 1379 (flow orifice 1379-1, flow orifice 1379-2, and flow orifice 1379-3) that traverse the thickness of the wall 1339. The flow orifices 1379 in the side wall 1339 of the chamber 1351 in this example are coincident (e.g., vertically aligned) with the flow orifice 1268 in the wall 1277 of the housing 1259 of the sub 1390. The flow orifices 1379 of the chamber 1351 have a footprint 1387 (e.g., a width, a cross-sectional shape, a length) that is substantially identical to each other in this example. Collectively for the three footprints 1387 (footprint 1387-1, footprint 1387-2, and footprint 1387-3) are less than the footprint 1297 of the flow orifice 1268 in the wall 1277 of the housing 1259.

The actuator 1355 of the ASRICV 1350 is configured to move the sleeve 1335 within the chamber 1351 based on a differential in pressure between the cavity 1218 and/or the cavity 1362 ($p_i$) within the sub 1390 and outside ($p_o$) the sub 1390. The actuator 1355 in this case includes a single component in the form of a resilient device (e.g., a spring). The actuator 1355 operates without any external controller and/or without any electrical components. Specifically, in this case, the actuator 1355 is positioned within a part of the cavity 1353 of the chamber 1351 in a space 1342 defined by the side wall 1339 of the chamber 1351, the distal end of the distal wall 1372 of the sleeve 1335, and the distal wall 1374 of the chamber 1351.

The spring of the actuator 1355 is located within the space 1342 against an internal side wall 1344 that extends laterally inward from the side wall 1339 of the chamber 1351 and is positioned downstream from the distal wall 1372 of the sleeve 1335. The internal side wall 1344 has an aperture that traverses its thickness sufficient to allow for the extension 1321 (discussed below) of the sleeve 1335 to pass therethrough and move back and forth therein. In some cases, the position of the internal side wall 1344 may be adjustable within the space 1342 based on the characteristics of the spring and different target flow rates of the portion 1276-2 of the fluid 1345 for various pressure differential conditions. The space 1342 in which the actuator 1355 is positioned may be filled with air, any other fluid, and/or any other material to ensure reliable operation of the actuator 1355 over time. The side wall 1339 in this case includes an external pressure port 1358 that is in communication with the space 1342 adjacent to the spring.

The actuator 1355 in this example is configured, when operated, to move the sleeve 1335 forward and/or backward within the chamber 1351. In this case, the side wall 1354 of the sleeve 1335 has three flow orifices 1336 (flow orifice 1336-1, flow orifice 1336-2, and flow orifice 1336-3) that traverse the thickness of the side wall 1354. When the sleeve 1335 is in the open position, the flow orifices 1336 of the sleeve 1335 are coincident (e.g., vertically aligned) with the flow orifices 1379 in the wall 1339 of the chamber 1351. The flow orifices 1336 of the sleeve 1335 have a footprint 1367 (e.g., a width, a cross-sectional shape, a length) that is substantially identical to each other in this example.

Collectively for the three footprints 1367 (footprint 1367-1, footprint 1367-2, and footprint 1367-3) are less than the footprint 1297 of the flow orifice 1268 in the wall 1277 of the housing 1259. In this example, the three footprints 1367 of the flow orifices 1336 are substantially the same as the three footprints 1387 of the flow orifices 1379. In this way, when the sleeve 1335 is in the open position, the characteristics of the effective footprints 1314 of the collective flow orifices 1316 are substantially the same as the corresponding characteristics of the footprints 1367 of the flow orifices 1336 and the footprints 1387 of the flow orifices 1379, as shown in FIG. 13B. In such cases when the sleeve 1335 is in the open position, a maximum portion 1276-2 of a fluid 1345 flowing through the cavity 1219 of the housing 1259 is diverted to the cavity 1218 of the side pocket 1284 and through the collective orifices 1316 to a subterranean formation while a remaining portion 1276-1 of the fluid 1345 continues to flow out the opposite end of the housing 1259 of the sub 1390.

As the actuator 1355 operates to move the sleeve 1335 to a closed position from the open position, as shown in FIGS. 13C and 13D, the flow orifices 1336 of the sleeve 1335 are no longer coincident (e.g., is no longer vertically aligned) with the flow orifices 1379 that traverse the thickness of the wall 1339 of the chamber 1351. As a result, the effective footprints 1314 of the collective orifices 1316 are reduced, which results in a lesser portion 1376-2 (where the amount of the portion 1376-2 is less than the portion 1276-2 of FIGS. 13A and 13B) of the fluid 1345 flowing through the cavity 1219 of the housing 1259 is diverted through the collective orifices 1316 to the subterranean formation while a remaining portion 1376-1 (where the amount of the portion 1376-1 is greater than the amount of the portion 1276-1) of the fluid 1345 continues to flow out the opposite end of the housing 1259. Because of the relatively large footprint 1297 of the flow orifice 1268, the flow orifice 1268 does not limit the effective footprints 1314 of the collective orifices 1316, regardless of the position of the sleeve 1335.

As discussed above, the actuator 1355 operates when the difference between the internal pressure (p) (in this case, the pressure within the cavity 1218) and the external pressure ($p_o$) [i.e., Δp] exceeds a minimum threshold value. When the actuator 1355 operates, the sleeve 1335 moves to control the effective footprints 1314 of the collective flow orifices 1316 and, ultimately, the flowrate at which a portion (e.g., 1276-2, 1376-2) of the 1345 fluid exits the sub 1390. In this example, the resultant forces from Δp act axially on the distal wall 1372 of the sleeve 1335. The various characteristics of the actuator 1355 (specifically, the spring) in this case may be selected by a user so that the actuator 1355 operates in the manner desired. For example, the preload force imposed by the spring may be used to control the point at which Δp is sufficiently large to operate the actuator 1355 and move the sleeve 1335. The compression stiffness of the spring may be used to control the rate at which the sleeve 1335 moves with changes in Δp.

The ASRICV 1350 in this case is configured to operate autonomously based on the Δp that the actuator 1355 of the ASRICV 1350 experiences locally. As a result, by moving the sleeve 1335 in a controlled fashion, the actuator 1355 (and so the ASRICV 1350 in general) self-regulates fluid flow in response to changes in Δp. FIGS. 13B and 13D illustrate detailed views of the sleeve 1335 in its fully-open (Δx 1382=0) and maximally-closed (Δx 1382=max) positions, respectively, where Δx 1382 represents the position of the sleeve 1335 relative to the fully open position. In this case, there is no internal pressure port (as what was used in the example embodiments of FIGS. 6 through 7B and 10 through 11B) because the part (e.g., portion 1276-2) of the fluid 1345 flows directly into the sleeve 1335.

When the internal pressure ($p_i$) exceeds the pressure ($p_o$) at the external pressure port 1358, the differential pressure ($\Delta p = p_i - p_o$) acting on the distal wall 1372 of the sleeve 1355 imposes a net force directed downstream, which in turn applies a force against the spring of the actuator 1355. The characteristics and behaviors of the spring may be substantially the same as what is described for the example embodiments of FIGS. 6 through 7B. In order to limit the range of the motion of the sleeve 1335, the ASRICV 1350 may include one or more stops 1352. In this case, the ASRICV 1350 has one stop 1352 in the form of a protrusion that extends inward toward the cavity 1362 of the sleeve 1335 from the side wall 1339 of the chamber 1351 around some or all of the perimeter of the chamber 1351. The stop 1352 in this case is positioned slightly downstream of the start of the straightaway for the side pocket 1284.

The sleeve 1335 in this case includes the side wall 1354, the distal wall 1372, and the extension 1321 that extends away from the distal wall 1372. The length of the extension 1321 is designed in such a way that the distal end of the extension 1321 is approximately a distance Δx 1382 away from the distal wall 1374 of the chamber 1351 when the sleeve 1335 is in the open position. In this way, when the sleeve 1335 is in the maximally closed position, the distal end of the extension 1321 abuts against the distal wall 1374 of the chamber 1351, preventing the sleeve 1335 from moving further downstream.

Figure 14:
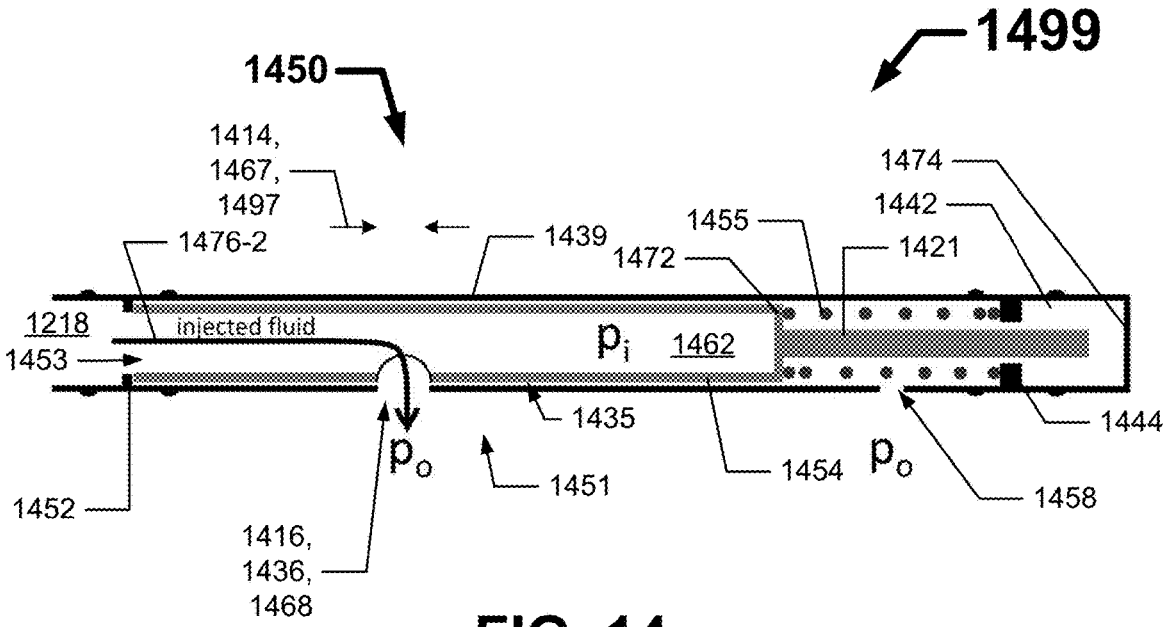
FIG. 14 shows part of yet another field system that can be used with the housing of FIGS. 12A and 12B according to certain example embodiments.

FIG. 14 shows part of yet another field system 1499 that can be used with the housing 1259 of FIGS. 12A and 12B according to certain example embodiments. Referring to the description of FIGS. 1 through 13D, the field system 1499 of FIG. 14 includes an ASRICV 1450 that can be inserted into the cavity 1218 of the side pocket 1284 of the housing 1259 of FIG. 12A. The ASRICV 1450 is substantially identical to the ASRICV 1350 of FIGS. 13A through 13D above, except that in this case there is only a single flow orifice 1468 having a footprint 1497 and that traverses the thickness of the side wall 1439 of the chamber 1451. Also, there is only a single flow orifice 1436 having a footprint 1467 and that traverses the thickness of the side wall 1454 of the sleeve 1435. Similarly, there is only a single effective footprint 1414 of a single collective flow orifice 1416.

The portion 1476-2 of the fluid (e.g., fluid 1345) flows through the collective flow orifice 1416, regardless of the position of the sleeve 1435. All other components (e.g., the actuator 1455, the extension 1421 of the sleeve 1435, the distal wall 1472 of the sleeve 1435, the side wall 1454 of the sleeve 1435, the cavity 1462 of the sleeve 1435, the cavity 1453 of the chamber 1451, the distal wall 1474 of the chamber 1451, the stop 1452, the internal side wall 1444, the external pressure port 1458, the space 1442 within the chamber 1451) of the ASRICV 1450 of FIG. 14 are substantially the same as the corresponding components of the ASRICV 1350 of FIGS. 13A through 13D.

Figure 15:
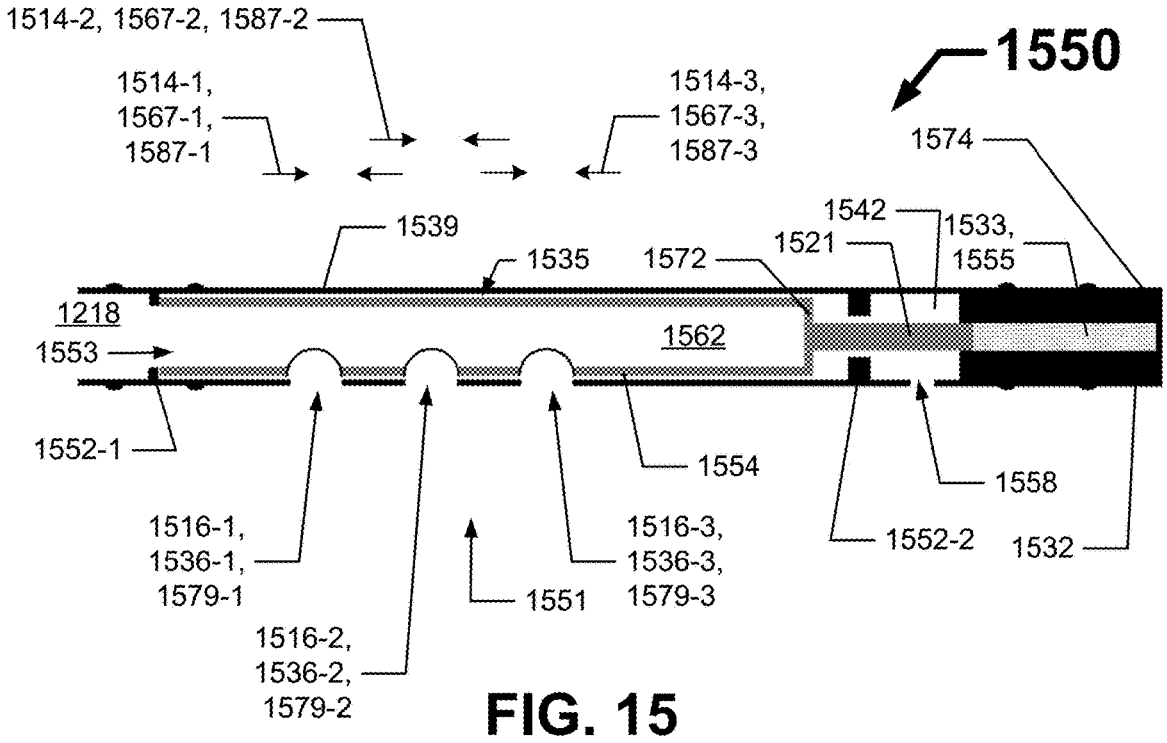
FIG. 15 shows a sectional side view of an ASRICV that can be used with the housing of FIGS. 12A and 12B according to certain example embodiments.
Figure 16A:
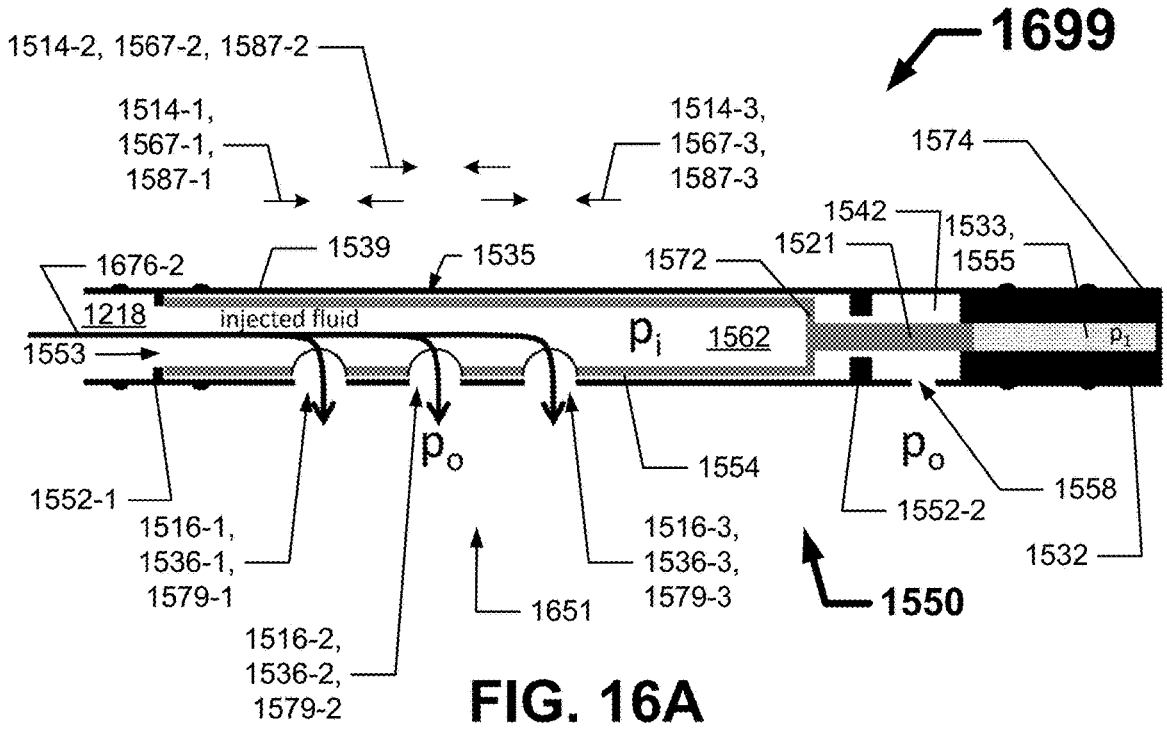
FIGS. 16A and 16B show part of still another field system that includes the ASRICV of FIG. 15 according to certain example embodiments.
Figure 16B:
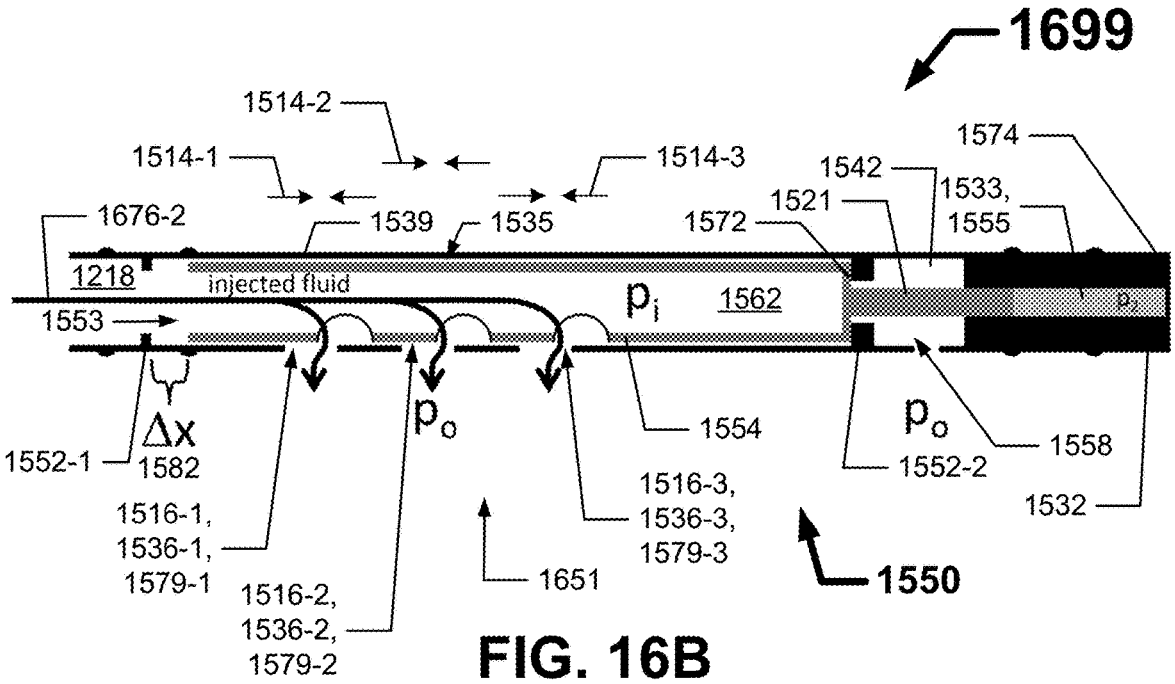

FIG. 15 shows a sectional side view of an ASRICV 1550 that can be used with the housing of FIGS. 12A and 12B according to certain example embodiments. FIGS. 16A and 16B show part of still another field system 1699 that includes the ASRICV 1550 of FIG. 15 with the sleeve 1535 in the open position and the maximally closed position, respectively, according to certain example embodiments. Referring to the description of FIGS. 1 through 14, the field system 1699, including the ASRICV 1550, is substantially the same as the field system 1399 of FIGS. 13A through 13D, except that in this case the actuator 1555 is in the form of a gas that fills a channel 1533 at the distal end of the space 1542 within the chamber 1551. In this way, the actuator 1555 is or includes a bellows.

Specifically, pocket 1532 has a channel 1533 therein that is filled by the gas. The channel 1533 is sealed at the proximal end of the channel 1533 by the distal end of the extension 1521 of the sleeve 1535. Regardless of the position of the sleeve 1535, at least a portion of the distal end of the extension 1521 of the sleeve 1535 is positioned within the proximal end of the channel 1533. The behavior and characteristics of the gas of the actuator 1555 may be substantially similar to the behavior and characteristics of the gas of the actuator 1055 of FIGS. 10 through 11B above.

All other components (e.g., the actuator 1555, the extension 1521 of the sleeve 1535, the distal wall 1572 of the sleeve 1535, the side wall 1554 of the sleeve 1535, the cavity 1562 of the sleeve 1535, the side wall 1539 of the chamber 1551, the cavity 1553 of the chamber 1551, the distal wall 1574 of the chamber 1551, the stop 1552-1, the stop 1552-2, the external pressure port 1558, the flow orifice 1579 and associated footprint 1587, the flow orifice 1536 and associated footprint 1567, the flow orifice 1516 and associated footprint 1514, Δx 1582) of the ASRICV 1550 of FIGS. 15 through 16B are substantially the same as the corresponding component of the ASRICV 1350 of FIGS. 13A through 13D.

FIGS. 17 through 22 show graphs showing how ASRICVs work over a range of pressure differentials according to certain example embodiments. Referring to the description of FIGS. 1 through 16B, the generalized performance of an example ASRICV can be determined using equations describing orifice flow and force balancing on the sliding sleeve. Flow through an orifice is described using the following equation:

$$Q=CA\sqrt{\Delta p}, \tag{1}$$

where C is a constant that includes unit conversions and the orifice's discharge coefficient and A is the orifice flow area. The force balance on the sliding sleeve is described using the following equation:

$$\Delta pA_{sleeve}=F_{preload}+\Delta xK, \tag{2}$$

where $A_{sleeve}$ is the area on the ends of the sliding sleeve, $F_{preload}$ is the spring's preload force and K is the spring's compression stiffness—and applies only when $\Delta pA_{sleeve} \geq F_{preload}$. Given this, equation (2) can be restated as:

$$\Delta x = \begin{cases} 0, & \Delta pA_{sleeve} < F_{preload} \\ \frac{1}{K}(\Delta pA_{sleeve} - F_{preload}), & \Delta pA_{sleeve} \geq F_{preload} \end{cases}. \tag{3}$$

Finally, equation (3) can be combined with equations describing how the flow orifice area varies as a function of Δx [i.e., A(Δx)], to ultimately yield an equation describing A in terms of Δp [i.e., A(Δp)]. This finally allows equation (1) to be restated as a function of Δp only. That is, $$Q=CA(\Delta p)\sqrt{\Delta p} \tag{4}$$

Figure 17:
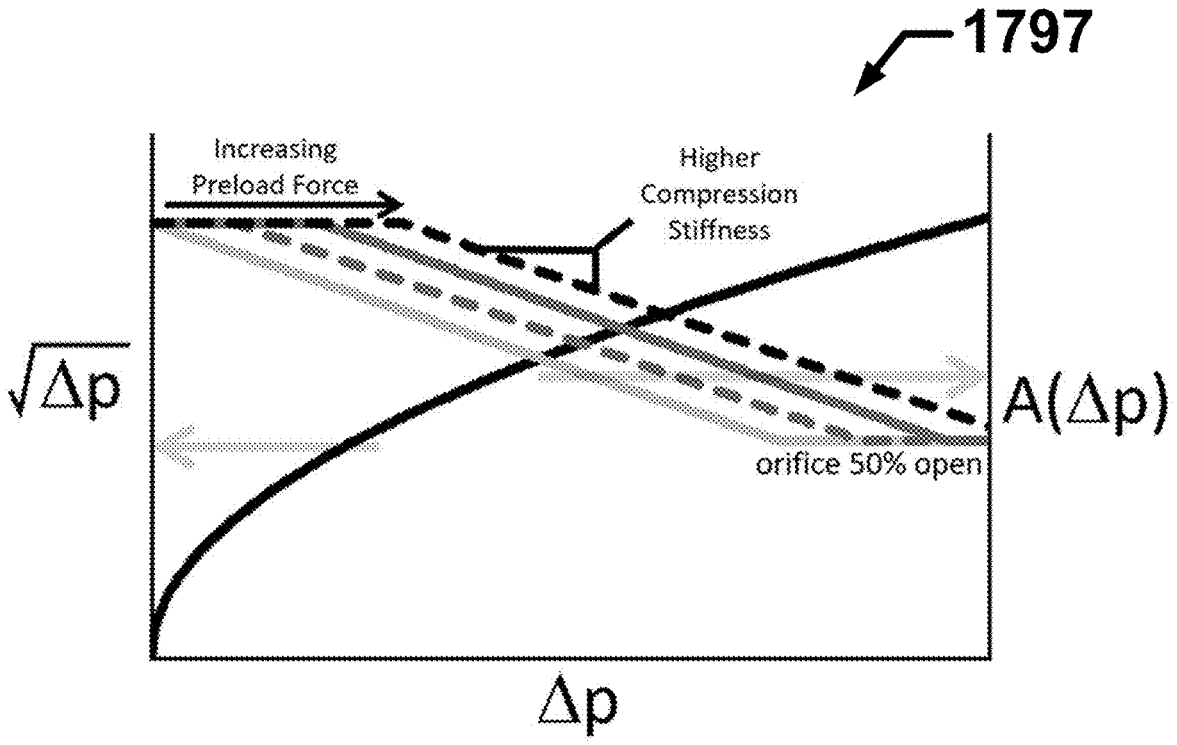
FIGS. 17 through 22 show graphs showing how ASRICVs work over a range of pressure differentials according to certain example embodiments.
Figure 18:
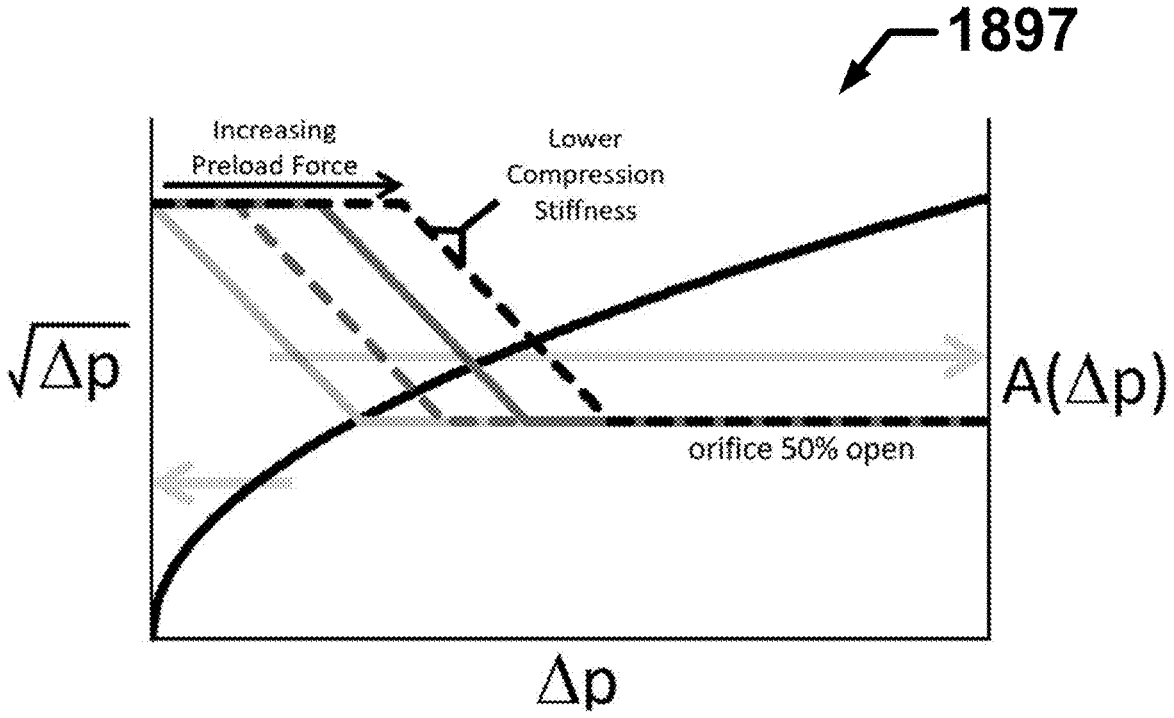

The graph 1797 of FIG. 17 displays $\sqrt{\Delta p}$ and a generalized A(Δp) versus Δp for example ASRICVs having notionally larger effective footprints of the collective flow orifices (also called variable-area orifices) and various settings (e.g., spring/bellows preload forces and compression stiffnesses) for actuators that have relatively higher compression stiffness (e.g., a higher spring constant). The graph 1897 of FIG. 18 displays $\sqrt{\Delta p}$ and a generalized A(Δp) versus Δp for example ASRICVs having notionally larger effective footprints of the collective flow orifices (also called variable-area orifices) and various settings (e.g., spring/bellows preload forces and compression stiffnesses) for actuators that have relatively lower compression stiffness (e.g., a lower spring constant).

Figure 19:
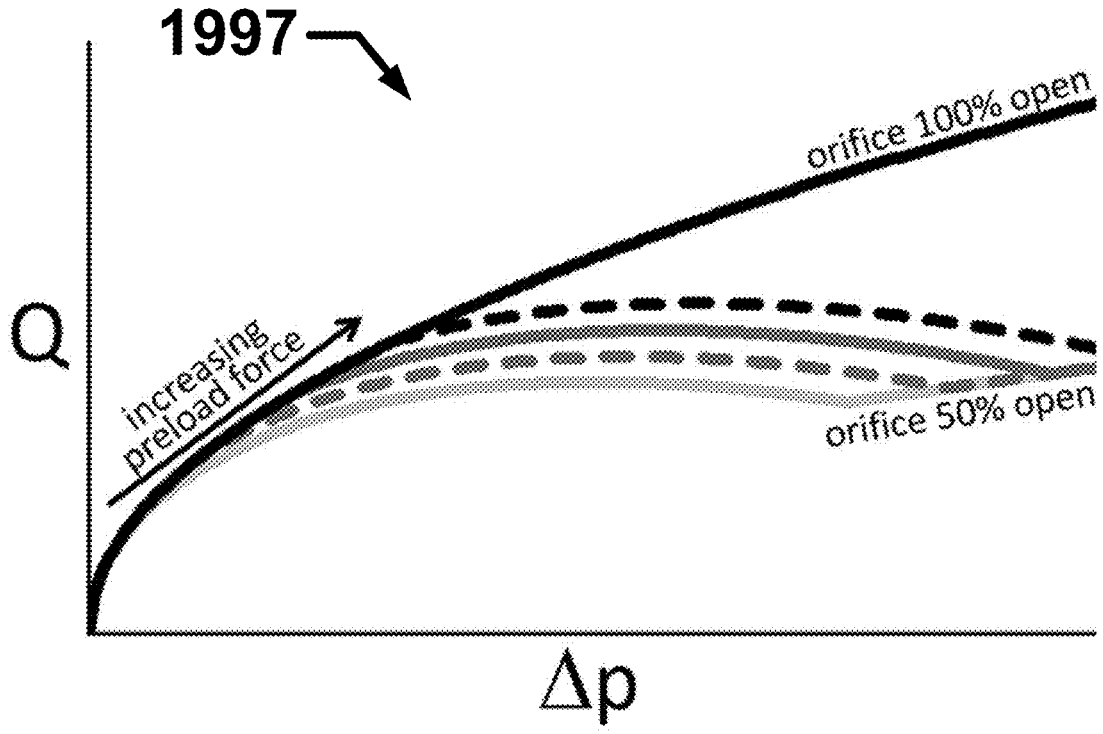
Figure 20:
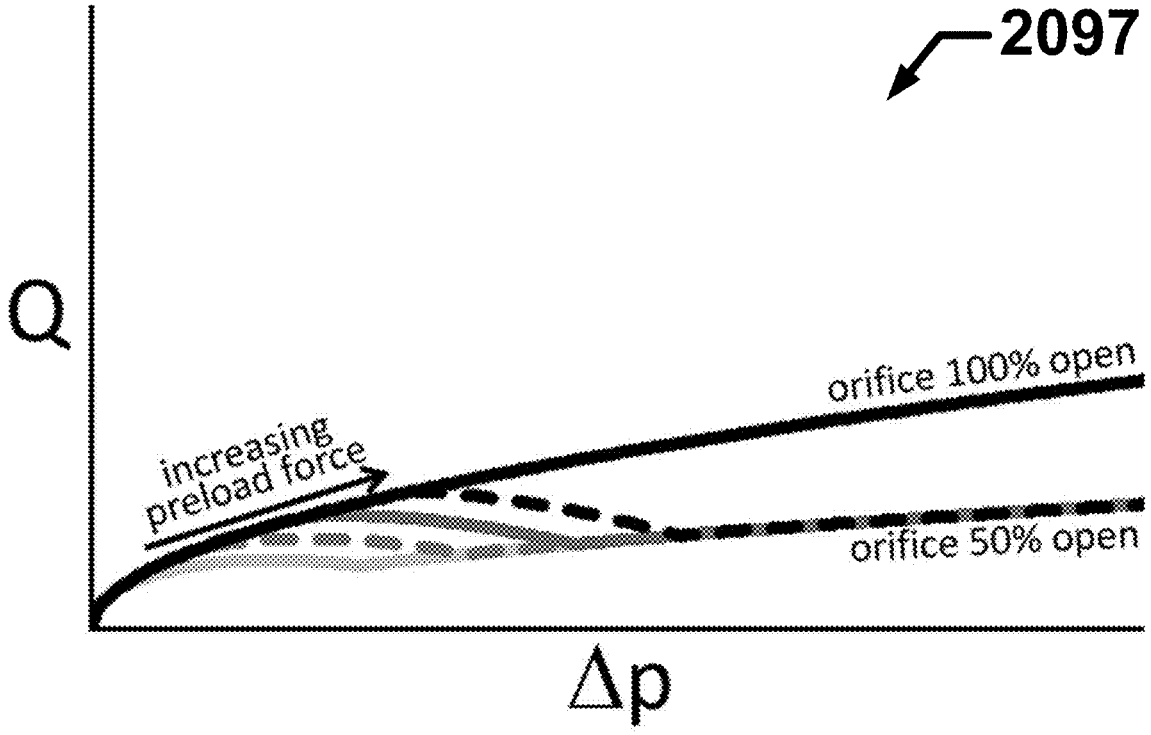
Figure 21:
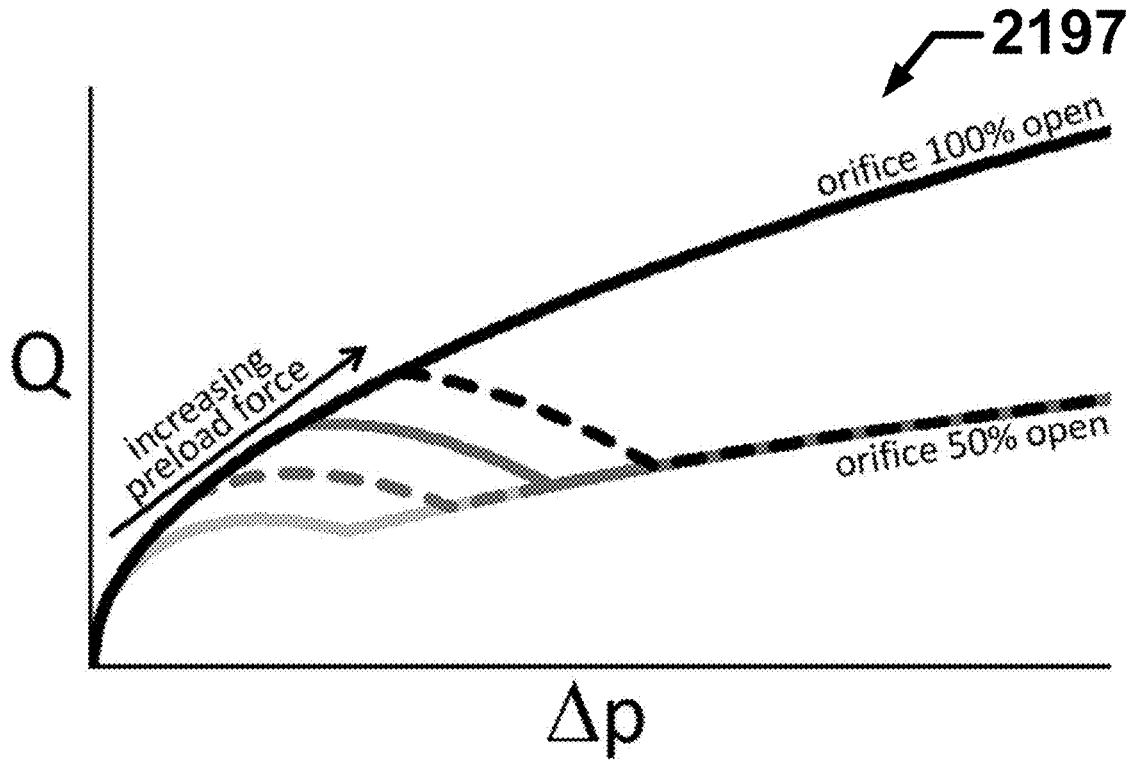
Figure 22:
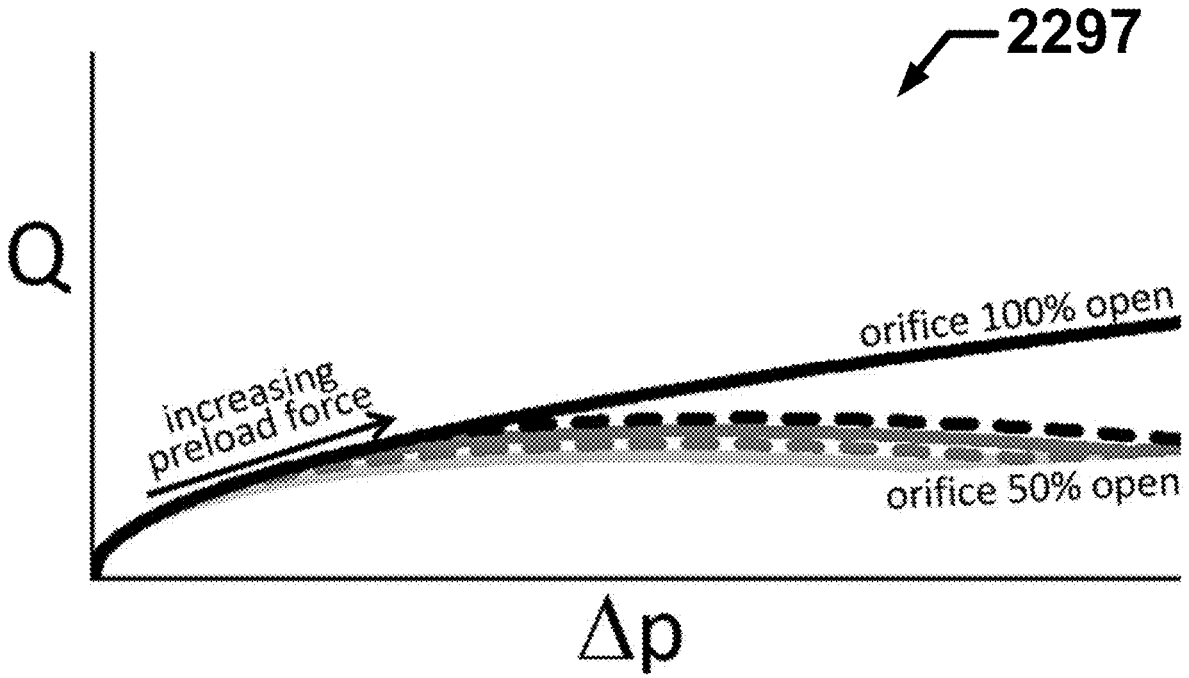

Considering that C in equation (4) is a constant, the general character of the flowrate performance of the example ASRICVs can be shown simply by multiplying $\sqrt{\Delta p}$ and A(Δp) to yield the results in the graph 1997 of FIG. 19, the graph 2097 of FIG. 20, the graph 2197 of FIG. 21, and the graph 2297 of FIG. 22. Specifically, the graph 1997 of FIG. 19 shows generalized flowrate performance of example ASRICVs where the size of the effective footprints of the collective flow orifices when the sleeves are maximally closed is approximately 50% of the size of the effective footprints of the collective flow orifices when the sleeves are open, where the effective footprints of the collective flow orifices when the sleeves are open are relatively large, and where the actuators have a relatively high spring constant.

The graph 2097 of FIG. 20 shows generalized flowrate performance of example ASRICVs where the size of the effective footprints of the collective flow orifices when the sleeves are maximally closed is approximately 50% of the size of the effective footprints of the collective flow orifices when the sleeves are open, where the effective footprints of the collective flow orifices when the sleeves are open are relatively small, and where the actuators have a relatively low spring constant.

The graph 2197 of FIG. 21 shows generalized flowrate performance of example ASRICVs where the size of the effective footprints of the collective flow orifices when the sleeves are maximally closed is approximately 50% of the size of the effective footprints of the collective flow orifices when the sleeves are open, where the effective footprints of the collective flow orifices when the sleeves are open are relatively large, and where the actuators have a relatively low spring constant.

The graph 2297 of FIG. 22 shows generalized flowrate performance of example ASRICVs where the size of the effective footprints of the collective flow orifices when the sleeves are maximally closed is approximately 50% of the size of the effective footprints of the collective flow orifices when the sleeves are open, where the effective footprints of the collective flow orifices when the sleeves are open are relatively small, and where the actuators have a relatively high spring constant.

The generalized flowrate performance curves in FIGS. 19 through 22 display the self-regulating nature of the example ASRICVs discussed herein. Using (1) the size of the effective footprint of the collective flow orifice (also called the variable-area orifice), (2) the size and shape of the variable-area orifice in relation to Δx, (3) the compression stiffness of an actuator in the form of a spring or bellows (or other form of gas receptacle), and (4) the preload force of the spring or bellows, the operating envelope of an example ASRICV can be uniquely designed for any flowrate range.

Irrespective of the operating envelope, however, the general design of an example ASRICV results in restricting runaway injection into intervals where permeabilities or fracture conductivities are sufficiently high to become thief zones, thereby robbing injection fluid from competing intervals. Optimal design and deployment of an example ASRICV may start with determining the maximum flowrate acceptable for each injection interval. Valves for each interval can then be designed, given the four design parameters above, to distribute the desired flowrate to each injection interval, while setting an upper limit as how much injection any one interval will be allowed.

Example embodiments may be used to provide systems and methods for subs that include autonomous self-regulating injection control valves for injecting fluid into a subterranean formation. Example embodiments result in a relatively uniform distribution of fluid along a section of a wellbore using autonomous, real-time control and without the use of controllers or remote intervention. Example embodiments may provide a number of benefits. Such benefits may include, but are not limited to, more reliable field operations, ease of installation and use, reduced downtime, increased flexibility, configurability, and compliance with applicable industry standards and regulations.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sub used for subterranean injections, the sub comprising:

a housing comprising a housing wall forming a cavity, wherein the housing is configured to be placed inline with a tubing string, and wherein the housing wall has a first flow orifice that traverses therethrough; and an autonomous self-regulating injection control valve (ASRICV) disposed within the cavity, wherein the ASRICV comprises:

a chamber disposed within the cavity, wherein the chamber is bounded by a chamber wall, wherein the chamber wall has a second flow orifice that traverses therethrough, and wherein the first flow orifice and the second flow orifice are aligned with each other;

a sleeve movably disposed within the chamber, wherein the sleeve has an open position and a plurality of closed positions, wherein the plurality of closed positions of the sleeve excludes a completely closed position, and wherein the sleeve partially covers the first flow orifice and the second flow orifice when in one of the plurality of closed positions; and an actuator disposed within the chamber and in communication with the sleeve, wherein the actuator is configured to move the sleeve between the open position and the plurality of closed positions, and wherein the actuator is configured to operate automatically based on a differential between a first pressure within the cavity and a second pressure outside the housing.

2. The sub of claim 1, wherein the actuator comprises a spring.

3. The sub of claim 1, wherein the actuator comprises a gas.

4. The sub of claim 1, wherein movement of the sleeve between the open position and the plurality of closed positions has a linear relationship to an amount of openness of the first flow orifice and the second flow orifice.

5. The sub of claim 1, wherein movement of the sleeve between the open position and the plurality of closed positions has a non-linear relationship to an amount of openness of the first flow orifice and the second flow orifice.

6. The sub of claim 1, wherein the ASRICV is concentric with a main flow path through the cavity of the housing.

7. The sub of claim 1, wherein the cavity of the housing comprises a main bore and a side pocket, wherein the ASRICV is positioned within the side pocket.

8. The sub of claim 1, wherein the sleeve comprises a third flow orifice that traverses a thickness of the sleeve, and wherein the third flow orifice overlaps the first flow orifice and the second flow orifice when the sleeve is not in one of the plurality of closed positions.

9. The sub of claim 1, wherein the ASRICV further comprises a stop disposed on the chamber wall, and wherein the stop is configured to abut against the sleeve when the sleeve is in the open position.

10. The sub of claim 1, wherein the ASRICV further comprises a stop disposed on the chamber wall, and wherein the stop is configured to abut against the sleeve when the sleeve is in a maximally closed position among the plurality of closed positions.

11. The sub of claim 1, wherein the first pressure is configured to be at a first pressure port between the chamber and the cavity upstream of the sleeve, and wherein the second pressure is configured to be at a second pressure port between the chamber and an annulus outside the housing downstream of the sleeve.

12. A tubing string used for injecting fluid into a subterranean formation, the tubing string comprising:

a plurality of tubing pipes coupled end to end; and a sub positioned between a first tubing pipe and a second tubing pipe of the plurality of tubing pipes, wherein the sub comprises:

a housing comprising a housing wall forming a cavity, wherein the housing comprises a first coupling feature disposed at a first end and a second coupling feature disposed at a second end, wherein the first coupling feature is configured to be coupled to the first tubing pipe, wherein the second coupling feature is configured to be coupled to the second tubing pipe, and wherein the housing wall has a first flow orifice that traverses therethrough; and an autonomous self-regulating injection control valve (ASRICV) disposed within the cavity, wherein the ASRICV comprises:

a chamber disposed within the cavity, wherein the chamber is bounded by a chamber wall, wherein the chamber wall has a second flow orifice that traverses therethrough, and wherein the first flow orifice and the second flow orifice are aligned with each other;

a sleeve movably disposed within the chamber, wherein the sleeve has an open position and a plurality of closed positions, wherein the plurality of closed positions of the sleeve excludes a completely closed position, and wherein the sleeve partially covers the first flow orifice and the second flow orifice when in one of the plurality of closed positions; and an actuator disposed within the chamber and in communication with the sleeve, wherein the actuator is configured to move the sleeve between the open position and the plurality of closed positions, and wherein the actuator is configured to operate automatically based on a differential between a first pressure within the cavity and a second pressure outside the housing.

13. The tubing string of claim 12, wherein the first coupling feature and the second coupling feature comprise mating threads.

14. A system for injecting fluid into a subterranean formation, the system comprising:

a fluid injection apparatus located at a surface, wherein the fluid injection apparatus is configured to deliver an injection fluid;

a tubing string inserted into a wellbore from the surface, wherein the tubing string comprises a plurality of tubing pipes, wherein the injection fluid is delivered by the fluid injection apparatus through a tubing cavity of the tubing string; and a sub positioned between two of the plurality of tubing pipes, wherein the sub comprises:

a housing comprising a housing wall forming a housing cavity that is part of the tubing cavity, wherein the housing comprises coupling features that are coupled to the two of the plurality of tubing pipes, and wherein the housing wall has a first flow orifice that traverses therethrough; and an autonomous self-regulating injection control valve (ASRICV) disposed within the housing cavity, wherein the ASRICV comprises:

a chamber disposed within the housing cavity, wherein the chamber is bounded by a chamber wall, wherein the chamber wall has a second flow orifice that traverses therethrough, and wherein the first flow orifice and the second flow orifice are aligned with each other;

a sleeve movably disposed within the chamber, wherein the sleeve has an open position and a plurality of closed positions, wherein the plurality of closed positions of the sleeve excludes a completely closed position, and wherein the sleeve partially covers the first flow orifice and the second flow orifice when in one of the plurality of closed positions; and an actuator disposed within the chamber and in communication with the sleeve, wherein the actuator is configured to move the sleeve between the open position and the plurality of closed positions, and wherein the actuator is configured to operate automatically based on a differential between a first pressure within the housing cavity and a second pressure outside the housing.

15. The system of claim 14, further comprising:

a second sub positioned between another two of the plurality of tubing pipes, wherein the second sub comprises:

a second housing comprising a second housing wall forming a second housing cavity that is part of the tubing cavity, wherein the second housing comprises coupling features that are coupled to the another two of the plurality of tubing pipes, and wherein the second housing wall has a first flow orifice that traverses therethrough; and a second ASRICV disposed within the second housing cavity, wherein the ASRICV comprises:

a second chamber disposed within the second housing cavity, wherein the second chamber is bounded by a second chamber wall, wherein the second chamber wall has a second flow orifice that traverses therethrough, and wherein the first flow orifice and the second flow orifice are aligned with each other;

a second sleeve movably disposed within the second chamber, wherein the second sleeve has an open position and a plurality of closed positions, wherein the plurality of closed positions of the second sleeve excludes a completely closed position, and wherein the second sleeve partially covers the first flow orifice and the second flow orifice when in one of the plurality of closed positions; and a second actuator disposed within the second chamber and in communication with the second sleeve, wherein the second actuator is configured to move the second sleeve between the open position and the plurality of closed positions, and wherein the second actuator is configured to operate automatically based on a second differential between a third pressure within the second housing cavity and a fourth pressure outside the second housing; and a packer disposed around the tubing string between the ASRICV and the second ASRICV.

16. The system of claim 15, wherein the packer substantially prevents fluid communication between a first area within the wellbore outside the tubing string in which the ASRICV is located and a second area within the wellbore outside the tubing string in which the second ASRICV is located.

17. The system of claim 15, wherein the packer allows fluid communication between a first area within the wellbore outside the tubing string in which the ASRICV is located and a second area within the wellbore outside the tubing string in which the second ASRICV is located.

18. The system of claim 14, wherein the first flow orifice in the housing wall of the housing of the sub is positioned adjacent to perforations in the subterranean formation.

19. The system of claim 14, wherein the first flow orifice in the housing wall of the housing of the sub is positioned adjacent to an open hole section within the subterranean formation.

* * * * *